US007366452B2

(12) United States Patent
Fujita et al.

(10) Patent No.: US 7,366,452 B2
(45) **Date of Patent: *Apr. 29, 2008**

(54) DEVELOPER SUPPLY CONTAINER AND ELECTROPHOTOGRAPHIC IMAGE FORMING APPARATUS

(75) Inventors: Akiyoshi Fujita, Numazu (JP); Atsushi Numagami, Hadano (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/565,755

(22) Filed: Dec. 1, 2006

(65) Prior Publication Data

US 2007/0098453 A1 May 3, 2007

Related U.S. Application Data

(62) Division of application No. 11/131,368, filed on May 18, 2005, now Pat. No. 7,174,122, which is a division of application No. 10/668,532, filed on Sep. 24, 2003, now Pat. No. 6,968,146.

(30) Foreign Application Priority Data

Sep. 30, 2002 (JP) ..... 2002/285582

(51) Int. Cl.
*G03G 15/08* (2006.01)

(52) U.S. Cl. ..... 399/258; 399/119; 399/120

(58) Field of Classification Search ..... 399/107, 399/111, 119, 120, 252, 258, 260, 262
See application file for complete search history.

(56) References Cited

U.S. PATENT DOCUMENTS 5,963,759 A 10/1999 Kojima et al. ..... 399/111
6,292,644 B1 * 9/2001 Goto et al. ..... 399/262
6,324,370 B1 11/2001 Isobe et al. ..... 399/258
6,385,416 B1 5/2002 Horikawa et al. ..... 399/111
6,564,029 B2 5/2003 Kojima et al. ..... 399/258
6,608,980 B2 8/2003 Murayama et al. ..... 399/111
6,684,040 B2 1/2004 Yokoi et al. ..... 399/119
6,697,588 B2 2/2004 Nakazato et al. ..... 399/111
6,704,521 B2 3/2004 Isobe et al. ..... 399/12

(Continued)

FOREIGN PATENT DOCUMENTS

EP 1 184 742 3/2002

(Continued)

*Primary Examiner*—Hoan Tran
(74) *Attorney, Agent, or Firm*—Fitzpatrick, Cella, Harper & Scinto

(57) ABSTRACT

A developer supply container supplies a developer to a process cartridge detachably mounted to an electrophotographic image forming apparatus. The process cartridge contains an electrophotographic photosensitive drum and a charging member for charging the drum. The developer supply container includes a developer accommodating portion, a developer supply opening for supplying the developer accommodated in the developer accommodating portion to the cartridge, a container closing member for opening and closing the developer supply opening, a first container guide guidable by an apparatus main assembly guide, a second container guide guidable by the main assembly guide, a container force receiving portion for receiving a force for opening the supply opening by movement of the closing member by engagement with a cartridge engaging portion provided in the cartridge, and a first container positioning portion engageable with a first main assembly positioning portion.

13 Claims, 11 Drawing Sheets

U.S. PATENT DOCUMENTS

| | | | | |
|---|---|---|---|---|
| 6,714,752 | B2 | 3/2004 | Ueno et al. | 399/117 |
| 6,829,455 | B2 | 12/2004 | Yasumoto et al. | 399/167 |
| 6,839,534 | B2 | 1/2005 | Matsuda et al. | 399/262 |
| 6,865,357 | B2 | 3/2005 | Fujita et al. | 399/111 |
| 6,873,815 | B2 | 3/2005 | Matsuda et al. | 399/260 |
| 6,934,490 | B2 * | 8/2005 | Koyama et al. | 399/120 |
| 2002/0025173 | A1 | 2/2002 | Isobe et al. | 399/12 |
| 2002/0031374 | A1 | 3/2002 | Matsuda et al. | 399/258 |
| 2002/0057924 | A1 | 5/2002 | Ueno et al. | 399/117 |
| 2002/0057928 | A1 | 5/2002 | Yasumoto et al. | 399/167 |
| 2002/0085854 | A1 | 7/2002 | Numagami et al. | 399/90 |
| 2002/0141788 | A1 | 10/2002 | Matsuda et al. | 399/260 |
| 2003/0049036 | A1 | 3/2003 | Ueno et al. | 399/25 |
| 2003/0123889 | A1 | 7/2003 | Isobe et al. | 399/27 |
| 2003/0133723 | A1 | 7/2003 | Fujita et al. | 399/111 |
| 2004/0062573 | A1 | 4/2004 | Matsuda et al. | 399/258 |

FOREIGN PATENT DOCUMENTS

| | | |
|---|---|---|
| JP | 2002-6608 | 1/2002 |
| JP | 2002-6695 A | 1/2002 |
| JP | 2002-72651 A | 3/2002 |
| JP | 2002-72652 A | 3/2002 |

* cited by examiner

DEVELOPER SUPPLY CONTAINER AND ELECTROPHOTOGRAPHIC IMAGE FORMING APPARATUS

This is a divisional application of application Ser. No. 11/131,368, filed May 18, 2005 now U.S. Pat. No. 7,174,122, which is a divisional application of application Ser. No. 10/668,532, filed Sept. 24, 2003, issued as U.S. Pat. No. 6,968,146 on Nov. 22, 2005.

FIELD OF THE INVENTION AND RELATED ART

The present invention relates to a developer supply container removably mountable in the main assembly of an electrophotographic image forming apparatus, and also to an electrophotographic image forming apparatus.

Here, an electrophotographic image forming apparatus means an apparatus for forming an image on recording medium (for example, recording paper, OHP sheet, etc.) with the use of an electrophotographic image forming method. As for examples of an electrophotographic image forming apparatus, there are electrophotographic copying machines, electrophotographic printers (laser beam printers, LED printers, etc.), facsimileing machines, word processors, etc.

Generally, an electrophotographic image forming apparatus uses developer in the form of microscopic particles in order to form an image. Thus, it is common practice to supply the main assembly of an electrophotographic image forming apparatus with developer with the use of a developer supply container, as the developer in the main assembly of an image forming apparatus is consumed. Developer is in the form of extremely fine particles as described above. Therefore, in order to prevent developer from scattering into the air during a developer supplying operation, a developer supply container is disposed in the image forming apparatus main assembly, and developer is supplied into a process cartridge in small increments from the developer releasing hole of a developer supply container, as image formation continues. This method of supplying the image forming apparatus main assembly with developer has been known (for example, Japanese Laid-open Patent Application 2002-6608 and U.S. Pat. No. 6,564,029).

SUMMARY OF THE INVENTION

The present invention is the result of the further development of the above described prior technologies.

More specifically, the present invention is the result of the further development of the positioning structure for positioning a developer supply container relative to the main assembly of an image forming apparatus when mounting the developer supply container into the apparatus main assembly.

The primary object of the present invention is to provide a developer supply container removably mountable in the main assembly of an electrophotographic image forming apparatus, and an electrophotographic image forming apparatus in which the above described developer supply container is removably mountable.

Another object of the present invention is to provide a developer supply container, which can be left in the main assembly of an electrophotographic image forming apparatus to supply the developer into the developer container of a process cartridge, and an electrophotographic image forming apparatus in which such a developer supply container is removably mountable.

Another object of the present invention is to provide a developer supply container, which is accurately positioned relative to the main assembly of an electrophotographic image forming apparatus when mounted into the electrophotographic image forming apparatus main assembly, and an electrophotographic image forming apparatus which employs such a developer supply container.

Another object of the present invention is to provide a developer supply container, which is reliably positioned relative to the main assembly of an electrophotographic image forming apparatus when mounted into the electrophotographic image forming apparatus main assembly, and an electrophotographic image forming apparatus which employs such a developer supply container.

Another object of the present invention is to provide an inexpensive developer supply container, which can be accurately positioned relative to the main assembly of an electrophotographic image forming apparatus when mounted into the electrophotographic image forming apparatus main assembly, and an electrophotographic image forming apparatus which employs such a developer supply container.

Another object of the present invention is to provide a developer supply container, which can be accurately positioned relative to the main assembly of an electrophotographic image forming apparatus, with the use of a simple structural arrangement, when mounted into the electrophotographic image forming apparatus main assembly, and an electrophotographic image forming apparatus which employs such a developer supply container.

Another object of the present invention is to provide a developer supply container, which is accurately positioned relative to the main assembly of an electrophotographic image forming apparatus by the container guides of the apparatus main assembly when mounted into the electrophotographic image forming apparatus main assembly, and an electrophotographic image forming apparatus which employs such a developer supply container.

Another object of the present invention is to provide a developer supply container, which allows the container guides of the main assembly of an electrophotographic image forming apparatus to have both the positioning function for accurately positioning the developer supply container relative to the apparatus main assembly, and the guiding function for guiding the developer supply container when the developer supply container is mounted into the electrophotographic image forming apparatus main assembly, and an electrophotographic image forming apparatus which employs such a developer supply container;

Another object of the present invention is to provide a developer supply container comprising: a container positioning portion which is located at the leading end the container, in term of the direction in which the container is mounted, and engages with the container positioning portion of the main assembly of an electrophotographic image forming apparatus in order to be accurately positioned relative to the main assembly so that the developer supply container is accurately positioned relative to the main assembly, when the container is mounted into the main assembly; and first and second container guides, the trailing ends of which, in terms of the container mounting direction, are supported by a pair of container guides of the main assembly so that the developer supply container is accurately positioned relative to the main assembly, when the developer supply container is mounted into the main assembly, and also to provide an electrophotographic image forming apparatus which employs such a developer supply container.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

First, the electrophotographic color image forming apparatus in the first embodiment of the present invention will be described with reference to the appended drawings. In the following descriptions, the lengthwise direction means the direction in which a development supply container is mounted into the main assembly of the electrophotographic image forming apparatus, and is intersectional with (virtually perpendicular to) the direction in which a recording medium 2 is conveyed. It also means the direction parallel to the axial direction of the electrophotographic photoconductive drum (which hereinafter will be referred to as photoconductive drum 7). The left and right sides mean the Left and right as seen from the direction from which the recording medium 2 is conveyed. Further, the top and bottom sides of the developer supply container mean the top and bottom sides of the development supply container when the development supply container is in the image forming apparatus main assembly.

[General Structure of Image Forming Apparatus]

First, referring to FIG. 1, the general structure of the electrophotographic image forming apparatus will be described.

Figure 1:
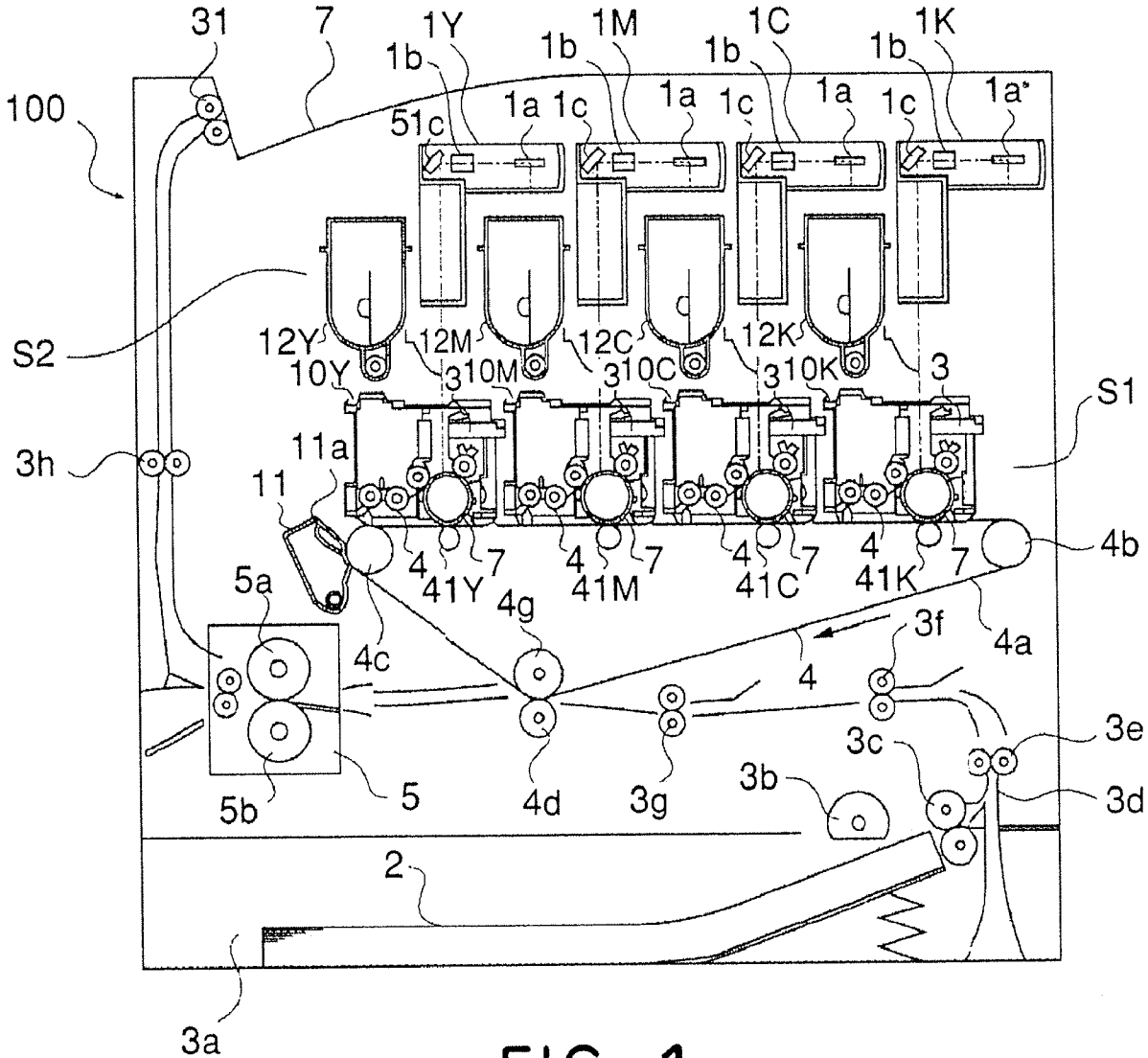
FIG. 1 is a side view of the electrophotographic color image forming apparatus in the first embodiment of the present invention.

FIG. 1 is a drawing for describing the general structure of a color laser beam printer, which is an example of a color image forming apparatus.

The image forming portion of the electrophotographic image forming apparatus (color laser beam printer) in this embodiment employs four process cartridges 10 (10Y, 10M, 10C, and 10K corresponding to yellow, magenta, cyan, and black color components, respectively), each of which has an electrophotographic photoconductive member 7 (which hereinafter will be referred to as "photoconductive drum") in the form of a drum. The four process cartridges 10 are disposed in parallel and are aligned in the horizontal direction. The image forming portion has four exposing means 1 (1Y, 1N, 1C, and 1K) (laser beam optical scanning system), which also are disposed in parallel and are aligned in the horizontal direction. The four exposing means 1 are located above the process cartridges 10 (10Y, 10M, 10C, and 10K), being roughly vertically aligned one for one with the four process cartridges 10.

Designated by a referential number 10Y is a cartridge for developing an electrostatic latent image with the use of yellow developer, and designated by a referential number 10M is a cartridge for developing an electrostatic latent image with the use of magenta developer. Designated by a referential number 10C is a cartridge for developing an electrostatic latent image with the use of cyan developer, and designated by a referential number 10K is a cartridge for developing an electrostatic latent image with the use of black developer.

Below the above described image forming portion, there are a feeding means for feeding the recording medium 2 into the main assembly, an intermediary transfer belt 4*a* for transferring a developer image formed on the photoconductive drum 7, onto the recording medium 2, and a secondary transfer roller 4*d* for transferring the developer images on the transfer belt 4*a*, onto the recording medium 2.

Also located below the image forming portion are a fixing means 5 for fixing the developer images to the recording medium 2 after the transfer of the developer images onto the recording medium 2, and discharging means 3*h* and 3*j* for discharging the recording medium 2 out of the image forming apparatus main assembly and accumulating it.

The recording medium 2 is a piece of recording paper, OHP sheet, fabric, or the like.

The image forming apparatus in this embodiment is a cleaner-less apparatus. Thus, the transfer residual toner, that is, the toner remaining on the photoconductive drum 7 after transfer is taken in by the developing means 10. Therefore, the process cartridges 10Y, 10M, 10C, and 10K are not provided with a cleaner dedicated to the recovery of the transfer residual toner.

Next, the structures of the various portions of the image forming apparatus will be described in detail in the logical order.

[Feeding Portion]

The feeding portion (feeding means) is a portion for feeding the recording medium 2 into the image forming apparatus main assembly and conveying it to the image forming portion. It comprises: a feeding cassette 3*a* which holds a plurality of recording mediums 2; a feeding roller 3*b*; a retard roller 3*c* for preventing two or more recording mediums 2 from being fed at the same time; a guide 3*d*; and a registration roller 3*g*.

The recording medium 2 is conveyed to the registration roller 3*g* by the conveying rollers 3*e* and 3*f* while being guided by the guide 3*d*.

[Process Cartridge]

Figure 2:
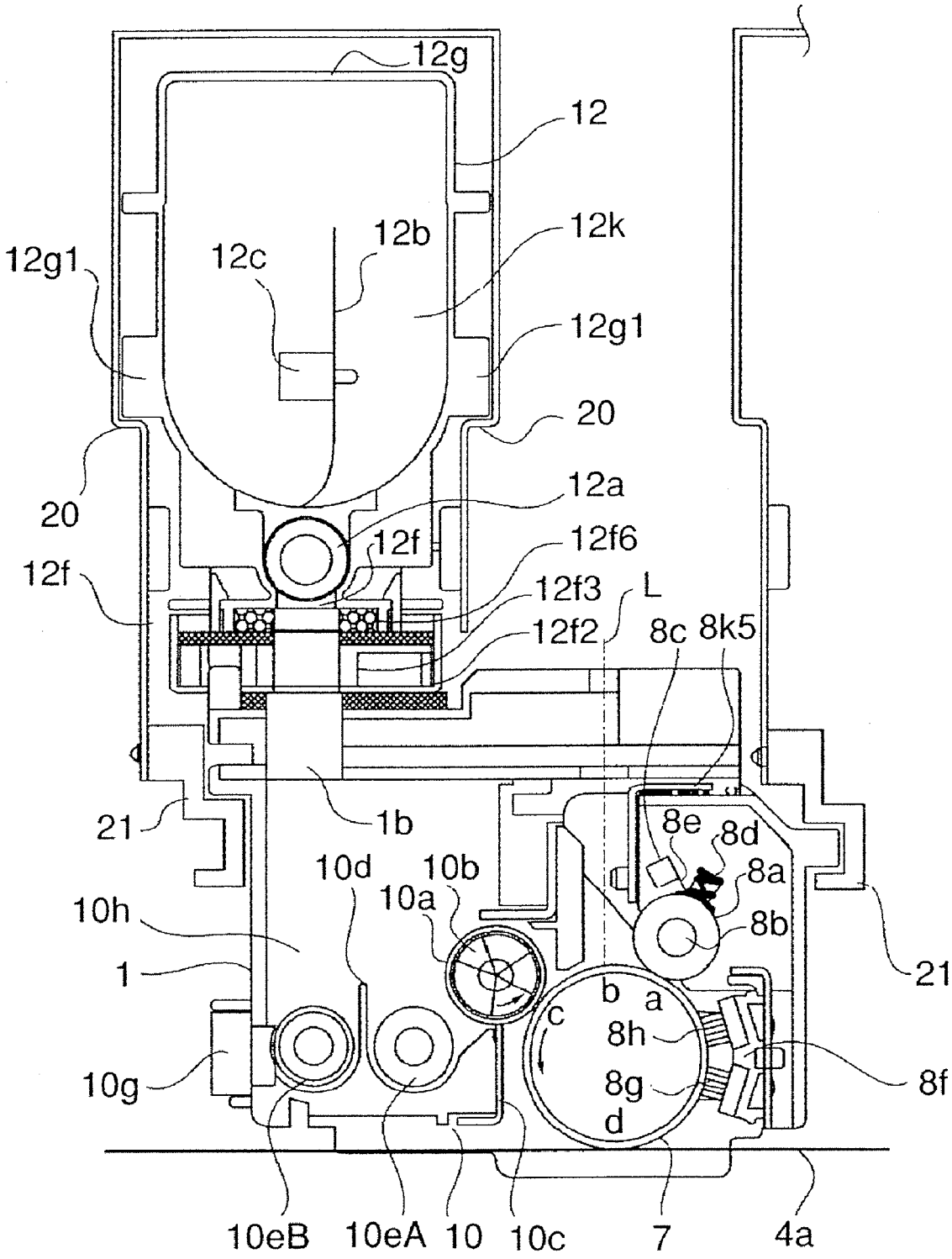
FIG. 2 is a side view of the process cartridge and developer supply container in the first embodiment of the present invention.

Referring to FIG. 2, each of the process cartridges 10 (10Y, 10M, 10C, and 10K) comprises the photoconductive drum 7, a charging means 8, and the developing means 10, which are integrally disposed in the cartridge shell, with the charging means 8 and developing means 10 being disposed in the adjacencies of the peripheral surface of the photoconductive drum 7. The process cartridges 10Y, 10M, 10C, and 10K can be easily removed from the main assembly of the electrophotographic image forming apparatus (which hereinafter will be referred to as "apparatus main assembly"). Thus, as the service life of the photoconductive drum 7 in a given process cartridge expires, the process cartridge is to be replaced by a user.

The photoconductive drum 7 is provided with a drum flange 7*b*, which is solidly fixed to one of the lengthwise ends of the photoconductive drum 7 (FIG. 4), that is, the inward end of the photoconductive drum 7 in FIG. 2. Also, the photoconductive drum 7 is provided with a flange 7*d*, which is solidly fixed to the front end of the photoconductive drum 7, from which the photoconductive drum 7 is not driven. Further, the photoconductive drum 7 has a drum shaft 7*a*, which penetrates the centers of the flanges 7*b* and 7*d*. The drum shaft 7*a*, and flanges 7*b* and 7*d* rotate together. In other words, the photoconductive drum 7 rotates about the axial line of the drum shaft 7*a*.

The front end portion of the drum shaft 7*a* is rotatably supported by a bearing 7*e*, which is solidly fixed to a bearing case 7*c*. Further, the bearing case 7*c* is solidly fixed to the frame of the process cartridge.

[Charging Means]

The charging means in this embodiment employs one of the contact type charging methods. It employs a charging member 8*a*, for example, a charge roller.

Referring to FIG. 2, the charge roller 8*a* is rotatably supported by a pair of bearings (unshown), at the lengthwise end portions of its metallic core 8*b*. It is kept pressured toward the photoconductive drum 7 by a pair of compression springs 8*d*; it is kept in contact with the peripheral surface of the photoconductive drum 7, so that a predetermined amount of contact pressure is maintained between the photoconductive drum 7 and the charge roller 8*a*. It is rotated by the rotation of the photoconductive drum 7.

Designated by a referential number 8*c* is a cleaning unit for cleaning the charge roller 8*a*. The charge roller cleaning unit 8*c* in this embodiment has a flexible cleaning film 8*e*, which extends in the lengthwise direction of the charge roller 8*a*, in parallel to the charge roller 8*a*. The cleaning film 8*e* is solidly fixed, by one of the long edges thereof, to a supporting member 8*f* which is reciprocally moved a predetermined distance in the lengthwise direction of the charge roller 8*a*. Thus, as the supporting member 8*f* is reciprocally moved by an external driving means, the peripheral surface of the charge roller 8*a* is rubbed by the cleaning film 8*e*. As a result, the contaminants (minute toner particles, external additive, etc.) adhering to the peripheral surface of the charge roller 8*a* are removed.

Incidentally, the image forming apparatus in this embodiment is of a cleaner-less type.

[Exposing Means]

In this embodiment, the aforementioned photoconductive drums 7 are exposed by the laser exposing means 1Y, 1M, 1C, 1K, one for one. More specifically, as image formation signals are sent to a given exposing means from the apparatus main assembly 100, a beam of laser light L is projected from the exposing means, while being modulated with the image formation signals, onto the uniformly charged peripheral surface of the photoconductive drum 7, in a manner to scan the peripheral surface of the photoconductive drum 7, selectively exposing the numerous points of the uniformly charged peripheral surface of the photoconductive drum 7 (FIG. 1). As a result, an electrostatic latent image in accordance with the image formation information is formed on the peripheral surface of the photoconductive drum 7.

The laser exposing means 1Y, 1N, 1C, and 1K each comprise: a solid laser element (unshown), a polygon mirror 1*a*, a focusing lens 1*b*, a reflection mirror 1*c*, etc.

[Developing Means]

The developing apparatuses 10 (10Y, 10M, 10C, and 10K) each are of a contact type developing apparatus which uses two-component developer (two-component magnetic brush type developing apparatus). Referring to FIG. 2, each developing means 10 comprises a development roller 10*a*, and a magnetic roller 10*b* disposed within the hollow of the development roller 10*a*. The development roller 10*a* holds a layer of developer 1, which is a mixture of carrier and toner, on its peripheral surface. The developing apparatus 10 also comprises a regulating blade 10*c*, which is disposed in the adjacencies of the peripheral surface of the development roller 10*a*, with the presence of a predetermined distance from the development roller 10*a*. As the development roller 10*a* is rotated in the direction indicated by an arrow mark, the body of developer on the peripheral surface of the development roller 10*a* is formed into a thin layer.

The development roller 10*a* has a pair of spacers (unshown), which are rotatably fitted around its lengthwise ends, one for one, maintaining thereby a predetermined gap between the development roller 10*a* and photoconductive drum 7. This gap is small enough for the layer of developer formed on the peripheral surface of the development roller 10*a* to make contact with the peripheral surface of the photoconductive drum 7 during a development operation.

The toner as one of the ingredients in the developer in this embodiment is such toner that is negative in inherent polarity and is 6 μm in average particle diameter. The magnetic carrier as another of the ingredients of the developer in this embodiment is 205 emu/cm$^3$ in saturation magnetization, and is 35 μm in average particle diameter. The ratio in weight between the toner and carrier in the developer is 6:94. The developer storage portion 10*h*, in which the developer is circulated, has two chambers divided by a partitioning wall 10*d* which extends in the lengthwise direction. It has stirring screws 10*e*A and 10*e*B, which are disposed on both sides of the partitioning wall 10*d*, one for one.

Figure 4:
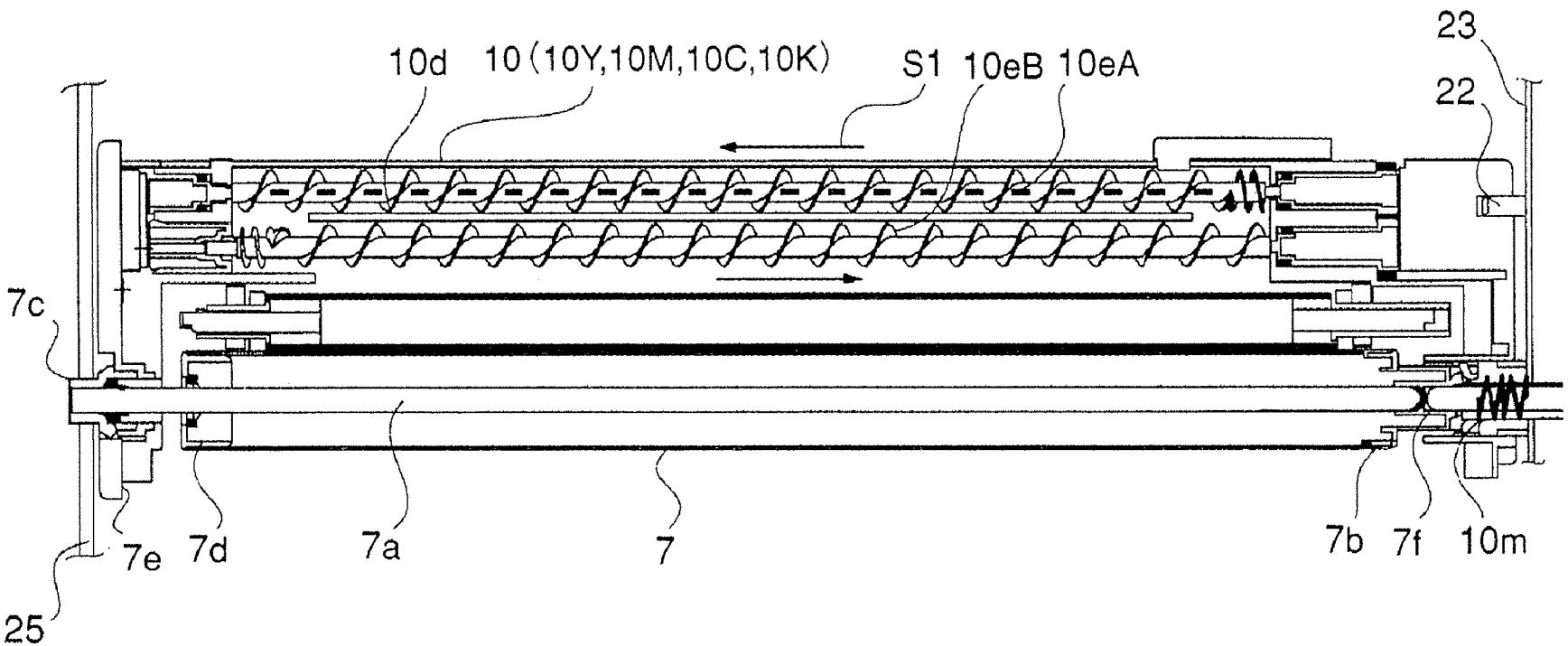
FIG. 4 is a sectional view of the process cartridge in the main assembly of the electrophotographic image forming apparatus.

Referring to FIG. 4, after being supplied from the developer supply container, the toner falls onto the back end portion (right end portion in drawing) of the stirring screw 10*e*B, and is conveyed frontward of the apparatus while being stirred. Then, it is moved through the gap between the front wall of the developer storage portion 10*h* and the partitioning wall 10*d*, and then, is conveyed backward of the developer storage portion 10*h* by the stirring screw 10*e*A. Then, it is moved through the gap between the back wall of the developer storage portion 10*h* and the partitioning wall 10*d*. In other words, the developer is repeatedly circulated by the stirring screws 10*e*B and 10*e*A in the developer storage portion 10*h*. Incidentally, the front side is the side on which a drum shaft positioning plate 25 is present, and the back side is the side on which the rear plate 23 is present.

As the toner is consumed by the development of an electrostatic latent image, the toner content of the developer decreases. In this embodiment, a sensor 10*g* for detecting the toner content is disposed in the adjacencies of the peripheral surface of a developer sending member 10*c*B. As it is detected by the sensor 10*g* that the toner content of the developer has reduced below a predetermined level, a command for supplying the developing apparatus 10 with the toner from the toner supply container is issued to initiate a toner supplying operation, which maintains the toner content of the developer in the developing apparatus at a predetermined level.

[Fixing Portion]

A developer image formed on the photoconductive drum 7 by the above described developing means 10 is transferred onto the recording medium 2 by way of the intermediary transfer belt 4*a*. Then, the fixing device 5 fixes the developer image having just been transferred onto the recording medium 2, to the recording medium 2.

Referring again to FIG. 1, the fixing apparatus 5 is provided with a fixing roller 5*a* for applying heat to the recording medium 2, and a pressure roller 5*b* for pressing the recording medium 2 against the fixing roller 5*a*. After the fixation, the recording medium 2 is discharged out of the apparatus main assembly 100 by the discharge rollers 3*h* and 3*j*, and is accumulated in the delivery tray 6 on top of the apparatus main assembly 100.

[Developer (Toner) Supply Container]

Next, referring to FIGS. 1-3, and FIGS. 4-11, the development supply container in accordance with the present invention will be described.

Figure 3:
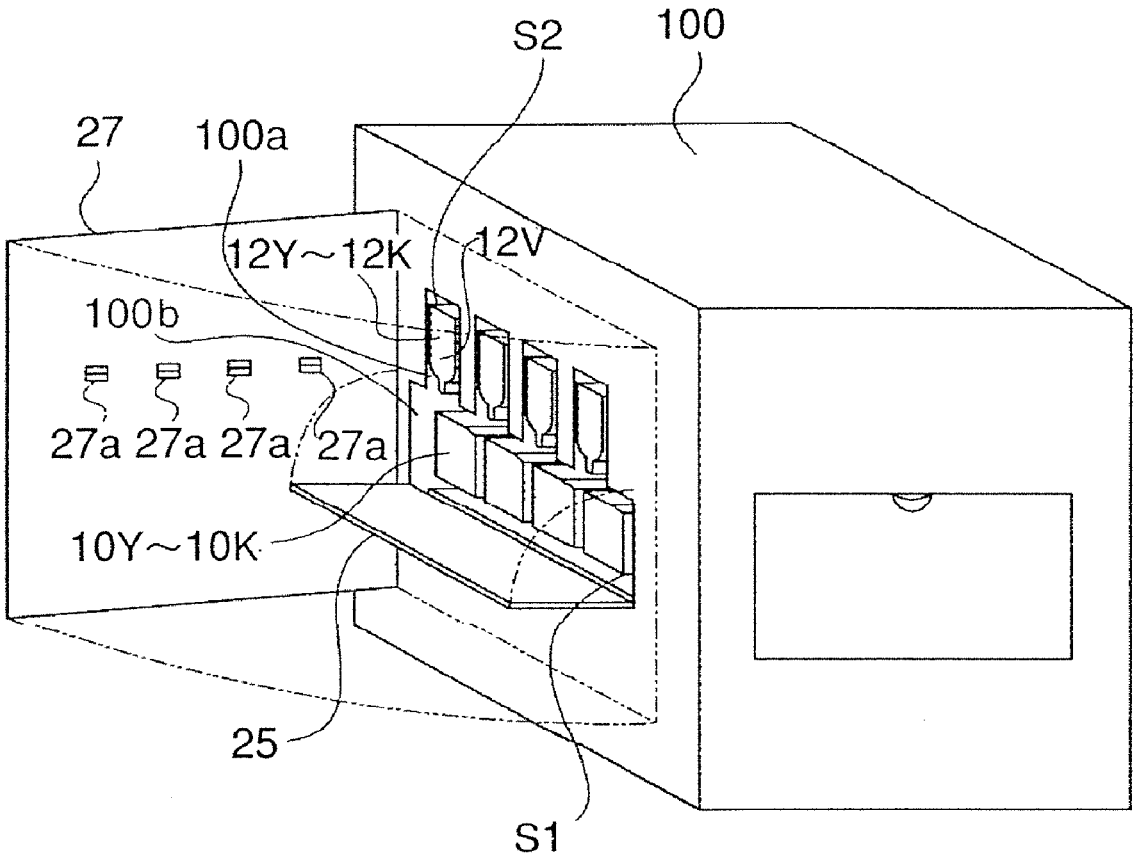
FIG. 3 is an external perspective view of the image forming apparatus shown in FIG. 1.

The development supply containers 12 (12Y, 12M, 12C, and 12K) are disposed in parallel above the process cartridges (10Y, 10M, 10C, and 10K), and are mounted into the apparatus main assembly 100 from the front side of the apparatus main assembly 100 (FIGS. 1 and 3).

Incidentally, designated by referential numbers 12Y, 12M, 12C, and 12K are developer supply containers for storing yellow, magenta cyan, and black toners, respectively.

Figure 5:
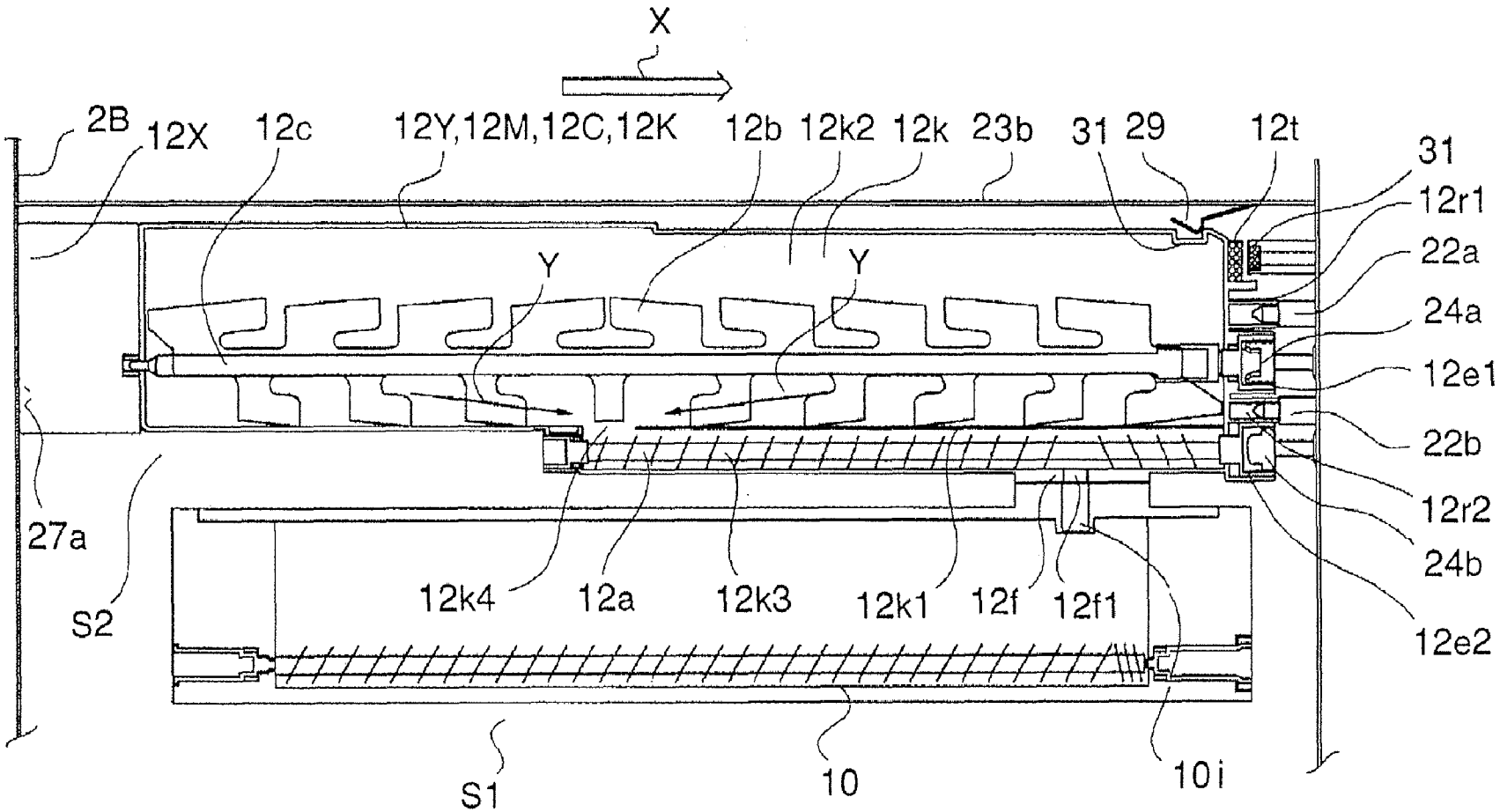
FIG. 5 is a sectional view of the developer supply container in the main assembly of the electrophotographic image forming apparatus.

Referring to FIGS. 3 and 5, each of the development supply containers 12 (12Y, 12N, 12C, and 12K) has a developer storage portion 12k, which stores toner within its frame 12*r*. Within the developer storage portion 12*k*, a developer sending top member 12*b* comprising a stirring shaft 12*c* and a plurality of stirring plates solidly fixed to the stirring shaft 12*c*, and a developer sending bottom member (screw) 12*a*, are disposed. The bottom wall of the developer storage portion 12*k* is provided with a developer outlet 12*f* having a developer releasing opening 12*f*1 through which the toner is discharged. The developer sending members 12*a* and 12*b* are rotatably supported by their lengthwise ends. The developer sending bottom member 12*a* is provided with a driving force receiving portion (female coupling) 12*e*2, which is attached to one of the lengthwise ends of the bottom developer sending member 12*a*, and the stirring shaft 12*e* is provided with a driving force receiving portion (female coupling) 12*e*1), which is attached to one of the lengthwise ends of the stirring shaft 12*c*. The driving force receiving portions (female couplings) 12*e*1 and 12*e*2 receive the driving force transmitted from the driving force transmitting members (male couplings) 24*a* and 24*b* of the apparatus main assembly 100, and are rotated thereby.

The screw as the developer sending member 12*a* comprises a central shaft, and two pieces of spiral ribs attached to the central shaft in a manner to wrap the center shaft, with the presence of a gap between the two spiral ribs. The position of the gap corresponds to that of the aforementioned developer outlet 12*f*. The spiral rib on one side of this gap is opposite to the spiral rib on the other side, in the direction in which the spiral ribs are twisted (FIG. 5). The developer sending member 12*a* is rotated in the predetermined direction by the rotation of the driving force transmitting member (male driving coupling) 24*b*, sending therefore the toner toward the developer outlet 12*f*. As a result, the toner free falls through the developer releasing opening of the developer outlet 12*f* into the cartridge 10 (10Y, 10M, 10C, and 10K); in other words, the cartridge 10 is supplied with the toner.

The peripheral edge, that is, the outermost edge of each stirring plate of the developer sending member 12*b*, in terms of the rotational radius of the developer sending member 12*b*, is angled relative to the stirring shaft 12*c* (FIG. 5). Thus, as each stirring plate rubs against the internal surface (internal surface of toner storage portion 12*k*) of the developer supply container 12 (12Y, 12, 12C, and 12K), its peripheral edge portion is angled at certain degrees relative to its base portion. More specifically, the peripheral edge portion of the stirring plate is spirally twisted. Thus, as the peripheral edge portion of each stirring plate of the developer sending member 12*c* is spirally twisted as the developer sending member 12*b* is rotated, the developer is conveyed in the direction parallel to the shaft of the stirring shaft 12*c*; the toner is sent in the lengthwise direction.

To theorize the manner in which the amount of the toner in the toner supply container 12 (12Y, 12M, 12C, and 12K) reduces, if the toner is discharged primarily from the adjacencies of the aforementioned developer outlet 12*f*, an inverse conical hole is created in the body of toner in the toner supply container 12; the toner is not uniformly supplied from the entire range of the toner supply container 12. Uneven toner reduction such as the above described one is not desirable for supplying the developing apparatus with toner at a constant rate.

In this embodiment, however, the toner is conveyed to the toner outlet 12*f* as described before. Therefore, the toner is supplied (discharged) at a constant rate.

Each of the development supply containers 12 (12Y, 12M, 12C, and 12K) is provided with an IC memory unit 12, which is attached to the leading end thereof in terms of the direction in which the developer supply container 12 is mounted. In the IC memory unit 12, the data regarding the development supply container and the main assembly of the developing apparatus, are stored, making possible the data communication between the communication control board 31 on the main assembly side, and the developer supply container 12.

Not only can the development supply container in this embodiment supply toner to a process cartridge, or a development cartridge, based on a two-component developing method, but also to a process cartridge or a development cartridge based on a single-component developing method. Further, the powder to be stored in the development supply container does not need to be limited to toner. For example, it may be the so-called developer, that is, a mixture of toner and magnetic carrier, which is needless to say.

In other words, in this specification, developer means toner as well as a mixture of toner and magnetic carrier. Therefore, the developer supply container in accordance with the present invention includes a developer supply container which supplies only toner as developer, and also, a developer supply container which supplies the so-called developer, that is, a mixture of toner and magnetic carrier.

[Mounting of Process Cartridge and Developer Supply Container]

Next, referring to FIGS. 2, 3, 5, 7, and 10, the sequential steps through which the process cartridges 10 or developer supply containers 12 are mounted into the image forming apparatus main assembly 100 will be described.

Referring to FIG. 3, the apparatus main assembly 100 is provided with a door (front door) 27, which is located in the front panel of the apparatus main assembly 100 and can be freely opened or closed. As an operator opens the door 27 frontward, openings 100*a* and 100*b* through which the process cartridges 10 and development supply containers 12 (12Y, 12N, 12C, and 12K), are inserted, respectively, are exposed. The opening 100*b* through which the process cartridges 10 are inserted is provided with the drum shaft positioning plate 25, which is rotatably supported. Thus, when inserting or removing the cartridge 10, this drum shaft positioning plate 25 must be opened and closed.

Figure 7:
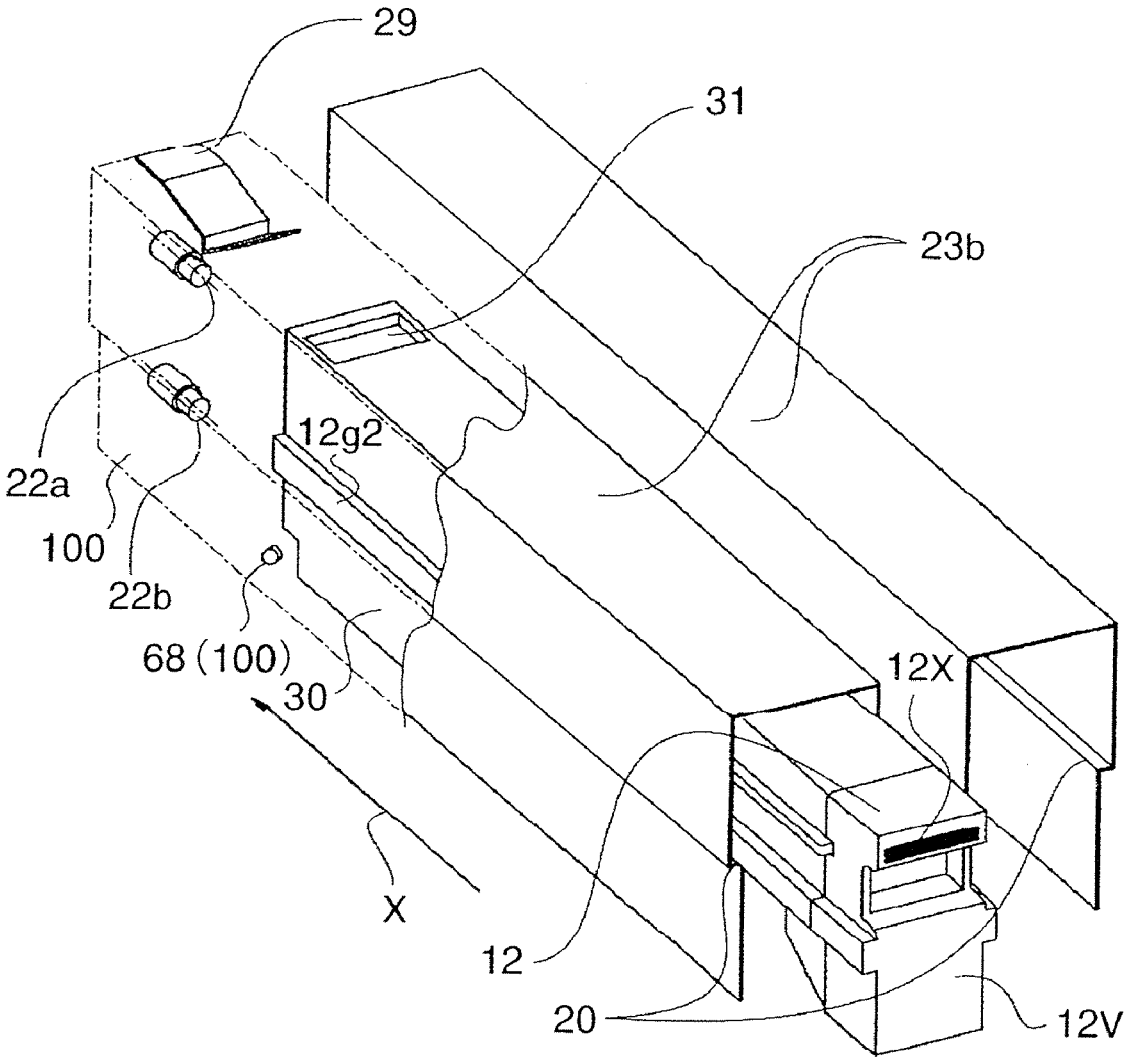
FIG. 7 is a perspective view of the developer supply container shown in FIG. 6, which is being mounted into the main assembly of the electrophotographic image forming apparatus.

Referring to FIGS. 2 and 7, there are solidly disposed four pairs of guides 21 for guiding the cartridge 10 when mounting the cartridge 10, and four pair of guides 20 for guiding the developer supply container 12 when mounting the developer supply container 12, in the apparatus main assembly 100.

The direction in which the process cartridge 10 is mounted into the apparatus main assembly 100 is parallel to the axial line of the photoconductive drum 7. The direction in which developer supply container 12 is mounted is parallel to the axial line of the developer sending member (screw) 12*a*. Further, the directions in which the guides 21 and 20 of the main assembly extend are the same as those in which the process cartridge 10 and development supply containers 12 are mounted. When mounting the process cartridge 10 or developer supply container 12 into the apparatus main assembly 100, first they are slid into the apparatus main assembly 100 along the guides 21 and 20 from the front side of the apparatus main assembly 100. As for the cartridge 10, as it reaches the deepest end of the apparatus main assembly 100, the deepest end of the drum shaft 7*a*, that is, the leading end of the drum shaft 7*a*, in terms of the direction in which the cartridge 10 is inserted, fits into the drum shaft positioning shaft 26 of the apparatus main assembly 100, whereby the deepest end of the photoconductive drum 7 is accurately positioned relative to the apparatus main assembly 100 in terms of its rotational axis. At the same time, the flange 7*b* engages with the driving coupling 10*m*, making it possible for the photoconductive drum 7 to be rotationally driven. Further, the rear wall 23 of the apparatus main assembly 100 is provided with four cartridge positioning portions 22 for positioning the cartridges 10Y, 10M, 10C, and 10K. Each positioning portion 22 of the apparatus main assembly 100 enters the recess 9*d*1 of the frame 10*f* of the inserted cartridge 10, whereby the leading end of the cartridge 10, in terms of the direction in which the cartridge is inserted, is accurately fixed in its position relative to the apparatus main assembly 100.

On the front side of the apparatus main assembly 100, the drum shaft positioning plate 25, which is rotationally opened or closed, is disposed, with which the bearing case 7*c* of the cartridge 10 is solidly engaged. Through the above described sequence of operational steps, the photoconductive drum 7 and cartridge 10 are accurately positioned relative to the apparatus main assembly 100.

In other words, the aforementioned drum shaft 7*a*, drum flange 7*b*, portion 9*d*1 with a recess, and bearing case 7*c*, constitute together the means for accurately positioning the cartridge 10 relative to the apparatus main assembly 100.

Figure 6:
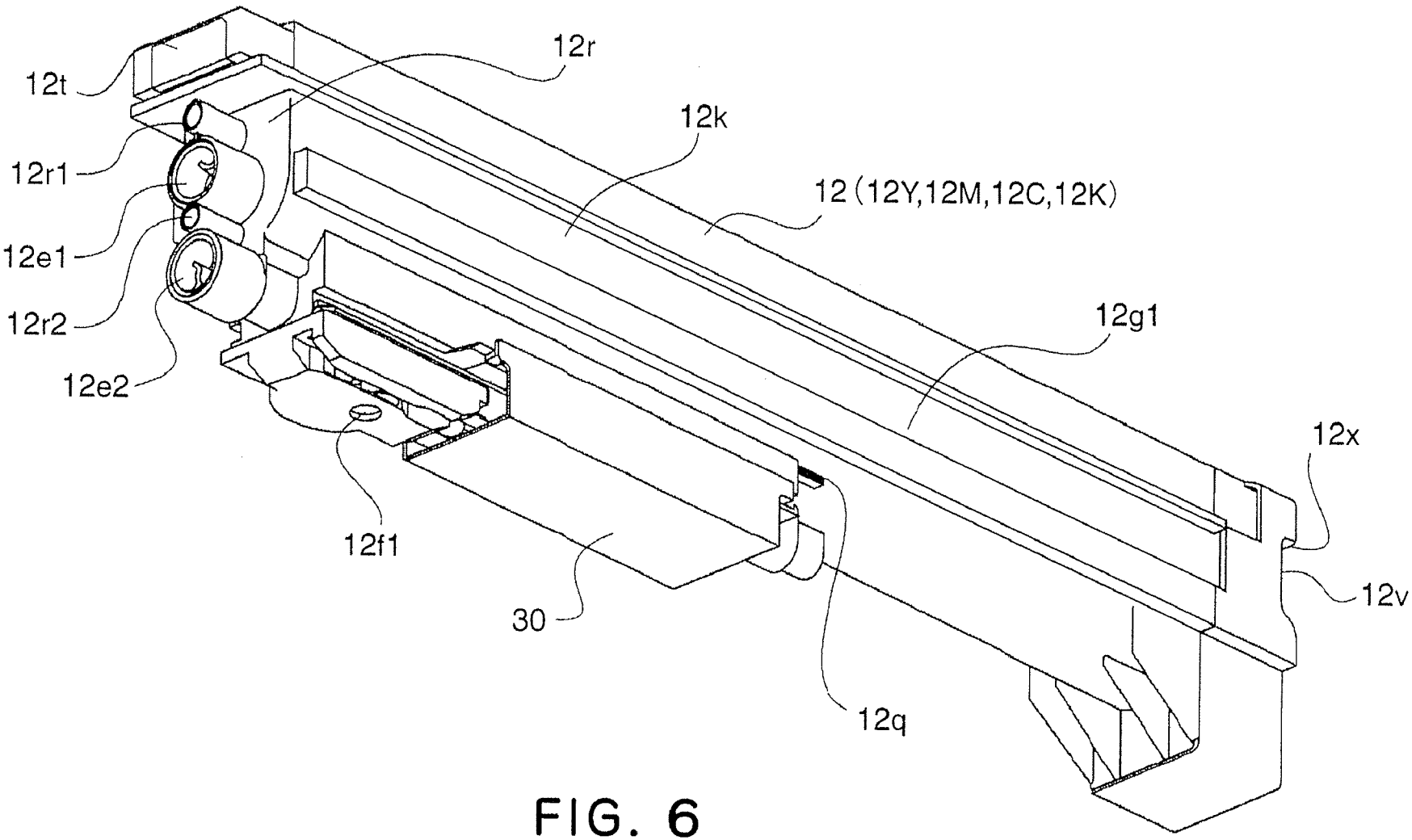
FIG. 6 is a perspective view of the developer supply container in the first embodiment of the present invention.

In comparison, referring to FIGS. 5-7, as the developer supply container 12 is inserted as far as it can be, that is, as it reaches the deepest end of the apparatus main assembly 100, a second positioning portion (supporting pin) 22*a* protruding from the rear wall 23 of the apparatus main assembly 100 enters the second positioning portion (portion with relatively deep blind hole) 12*r*1 on the end wall of the frame 12*r* of the developer supply container 12, at the leading end, whereby the position of the developer supply container 12 relative to the apparatus main assembly 100 in terms of the horizontal direction is fixed. Also, the first positioning portion (supporting pin) 22*b* protruding similarly from the rear wall 23 of the apparatus main assembly 100 enters the first positioning portion 12*r*2 (portion with blind hole) on the end wall of the frame 12*r* of the developer supply container 12, located at the deepest end of the apparatus main assembly 100, at the moment. As a result, the position of the leading end of the developer supply container 12, in terms of the direction in which the developer supply container 12 is inserted, relative to the apparatus main assembly 100, is fixed. At the same time, the driving force receiving portions (female driving couplings) 12*e*1 and 12*e*2 engage with the driving force transmitting members (male driving couplings) 24*a* and 24*b*, making it possible to rotationally drive the developer sending bottom member 12*a* and developer sending top member 12*b*.

The developer supply container 12 is provided with an elastic member catching portion 31, as a means for accurately positioning the developer supply container 12 in terms of the direction in which the developer supply container 12 is mounted into, or removed from, the apparatus main assembly 100, which is at the top of the developer supply container 12. Into this elastic force catching member 31, an elastic member 29, that is, a spring, with which a top wall 23*b* of each of the cartridge insertion chambers is provided, engages, whereby the position of the developer supply container 12 relative to the apparatus main assembly 100 in terms of the direction in which the developer supply container 12 is inserted is accurately fixed. In addition, the resiliency of the elastic member 29 keeps the developer outlet 12*f* of the developer supply container 12 in contact with the toner inlet 10*i* of the cartridge 10 in the apparatus main assembly 100. Further, the developer supply container 12 is kept pressed by the resiliency of a spring 27*a*, with which the door 27 is provided, from its trailing end (pressure taking area 12*v*) in terms of the cartridge insertion direction, whereby the developer supply container 12 is kept pressured forward in terms of the cartridge insertion direction, assuring that the first and second positioning portions 12*r*2 and 12*r*1 of the developer supply container 12 do not disengage from the first and second positioning portions 22*b* and 22*ac* of the apparatus main assembly 100, respectively, and that the couplings 12*e*1 and 12*e*2 do not disengage from the couplings 24*a* and 24*b*, respectively.

Further, as the developer supply container 12 is mounted into the apparatus main assembly 100, the trailing ends of the first and second container guides 12*g*1 and 12*g*2 of the developer supply container 12 are supported by the pair of the guides 20 of the apparatus main assembly 100.

In other words, the development supply containers 12Y, 12M, 12C, and 12K are accurately positioned relative to the apparatus main assembly 100 by the first and second positioning portions 22*a* and 22*b* of the apparatus main assembly 100, and first and second containing positioning portions 12*r*1 and 12*r*2 of the developer supply container 12. As for the driving force, it is transmitted by the couplings 12*e*1 and 12*e*2, and the driving force transmitting members 24*a* and 24*b*.

In summary, as the development supply containers 12(12Y, 12M, 12C, and 12K) are mounted into the apparatus main assembly 100, they are accurately positioned relative to the apparatus main assembly 100 in the following manner.

First, the first and second container positioning portions 12*r*1 and 12*r*2 of the developer supply container 12 engage with their counterparts, preventing the developer supply container 12 from rotating in the direction intersectional to the direction in which the developer supply container 12 is mounted. The second container positioning portion of the developer supply container engages with its counterpart. As a result, the leading end of the container 12 is accurately positioned relative to the apparatus main assembly 100. Further, the trailing side of the first and second guides 12*g*1 and 12*g*2 of the container 12 are supported by the guides 20 of the apparatus main assembly 100, whereby the trailing end of the container 12 is accurately positioned relative to the apparatus main assembly 100. Further, the container 12 is kept pressured downward by the resiliency of the elastic member 29, by the elastic force bearing member 31 of the top wall of the container 12, being thereby prevented from floating, and also, assuring that the developer outlet 12*f* remains in contact with the developer inlet 10*i*. Further, the container 12 is kept pressured forward, in terms of the cartridge insertion direction, from behind by the resiliency of the spring 27*a* of the door 27, which presses on the pressure-bearing portion 12*v*, that is, the end wall of the container 12, on the trailing side, whereby it is assured that the positioning portions 12*r*1 and 12*r*2 of the container 12 remain engaged with the positioning portions 22*a* and 22*b* of the apparatus main assembly 100, respectively. Incidentally, the couplings 12*e*1 and 12*e*2 mesh with the couplings 24*a* and 24*b*, respectively, transmitting thereby the driving force.

Next, the structure for opening or closing the developer outlet when mounting or dismounting the developer supply container 12 into the apparatus main assembly 100 will be described.

Referring to FIG. 7, the apparatus main assembly 100 is provided with a projection 68, which projects into the path through which the developer supply container 12 is inserted into the apparatus main assembly 100. Thus, as the developer supply container 12 is inserted, this projection 68 comes into contact with the cover 30 of the developer supply container 12. The arrow mark designated by a referential character X shows the direction in which the developer supply container 12 is mounted into the apparatus main assembly 100.

Figure 8:
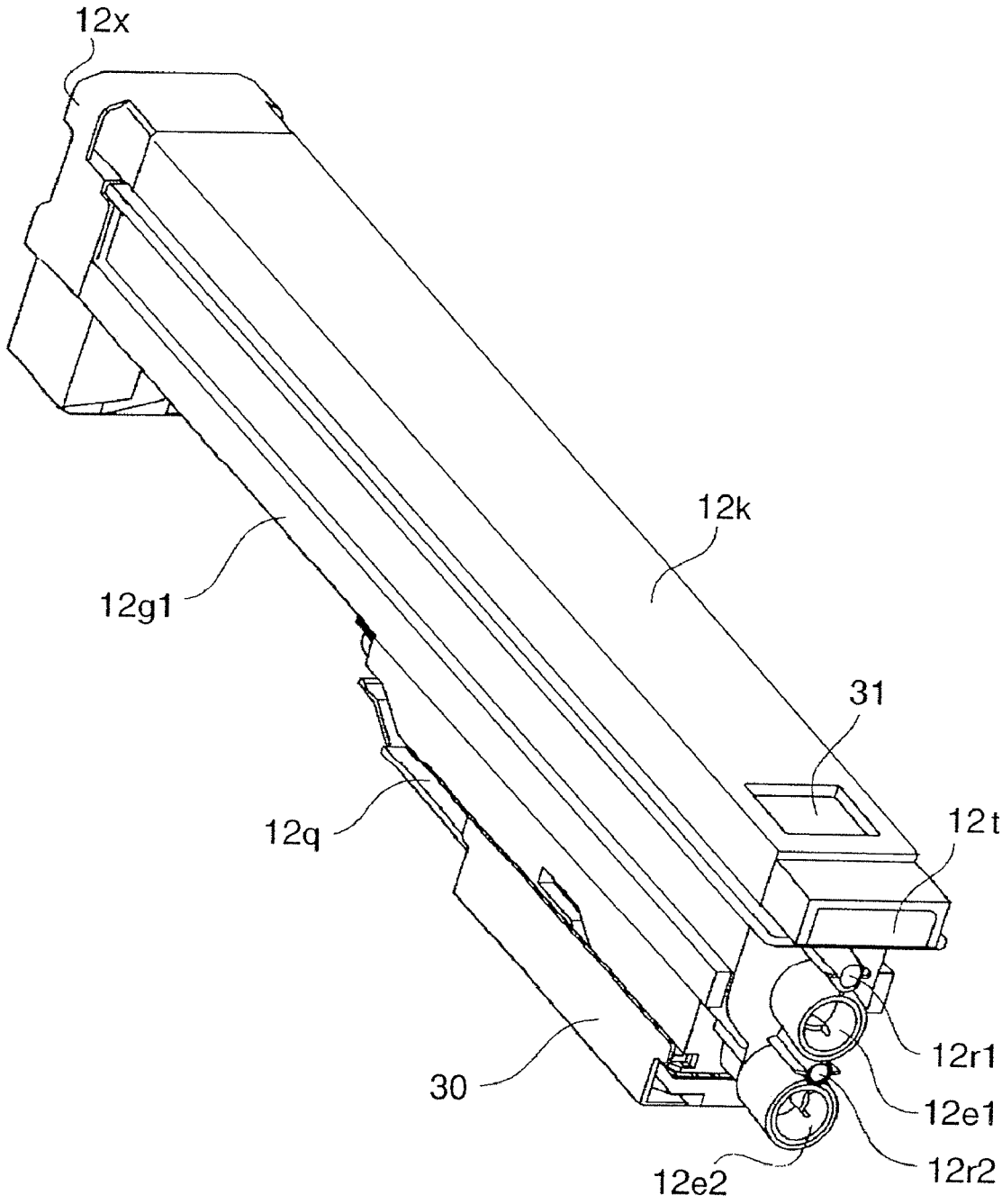
FIG. 8 is a perspective view of the development supply container shown in FIG. 6.
Figure 9:
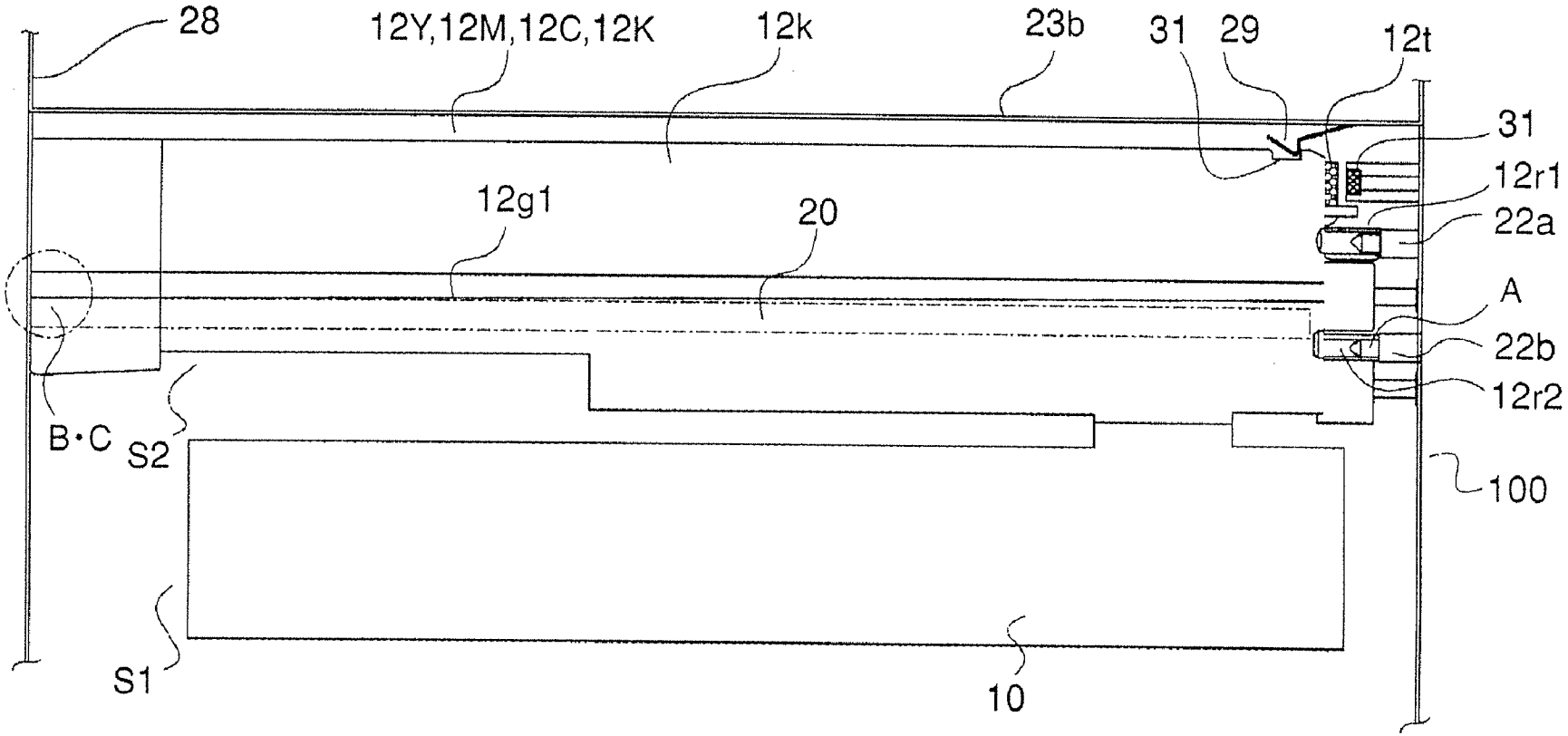
FIG. 9 is a side view of the development supply container in the main assembly of the electrophotographic image forming apparatus.

Referring to FIGS. 6 and 8, as the developer supply container 12 is inserted, the cover 30 is guided by the rail 12*g* of the developer supply container 12, being thereby moved toward the trailing end of the developer supply container 12. As a result, the opening 12*f*1 of the developer outlet 12*f* is exposed as shown in FIG. 6.

Figure 10:
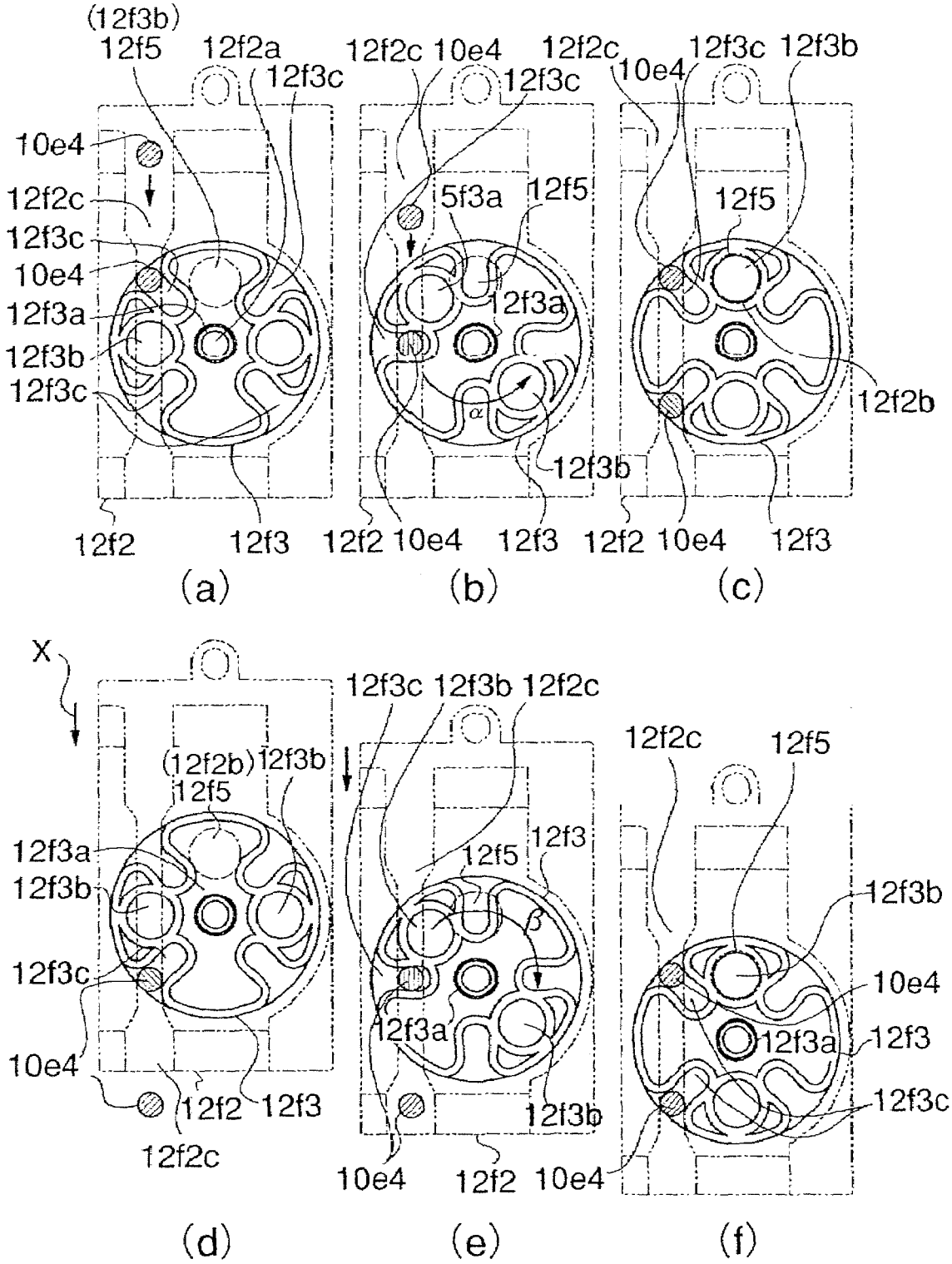
FIG. 10 is a plan view of the closing member.
Figure 11:
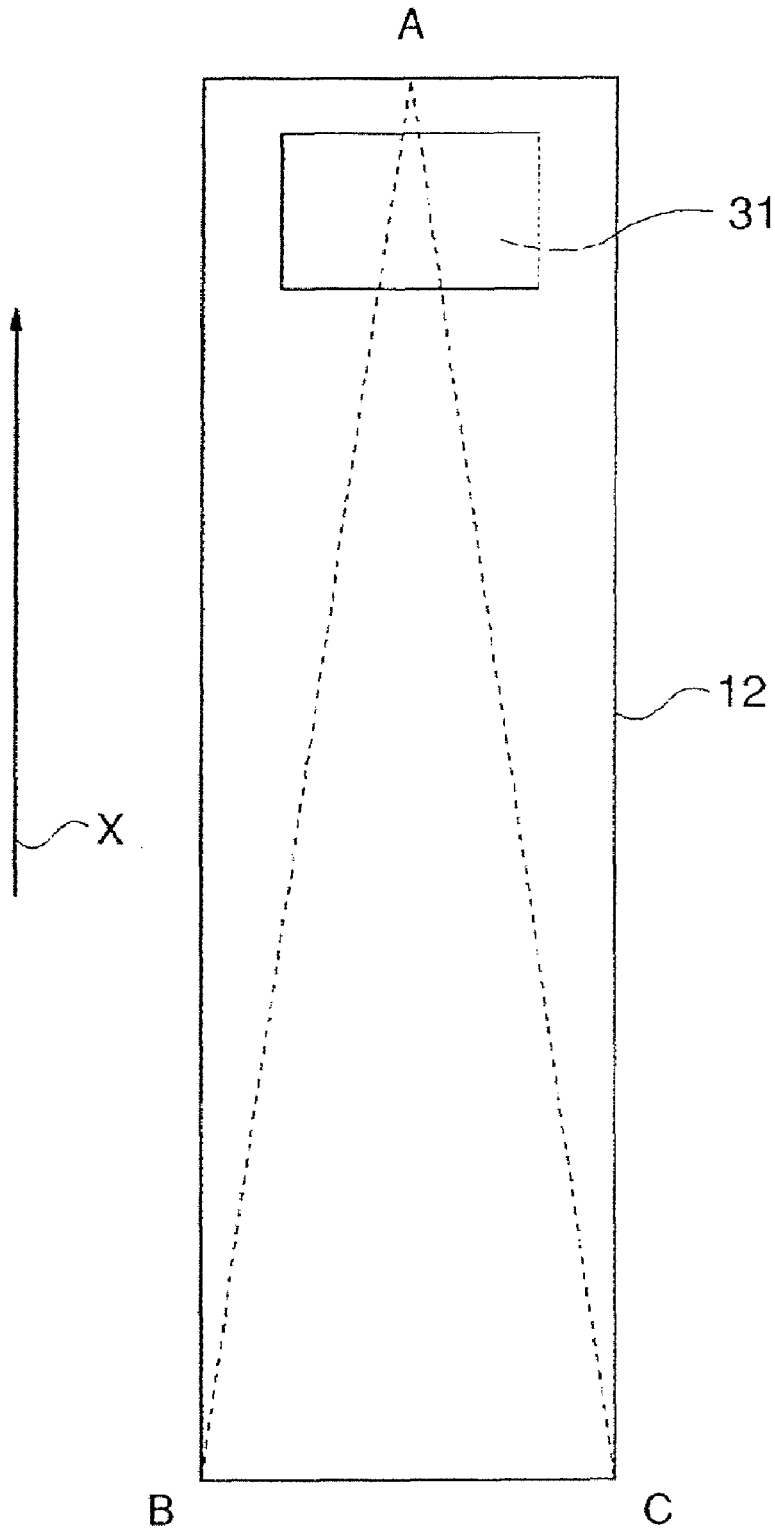
FIG. 11 is a schematic plan view of the development supply container, and its adjacencies, in the main assembly of the electrophotographic image forming apparatus.

FIG. 10 is a drawing for showing the operational movement of a closing member (shutter) 12*f*3. FIGS. 10(*a*)-10(*c*) show the sequential steps through which the cartridge 10 is inserted into the apparatus main assembly 100 in which the developer supply container 12 is already present. FIGS. 10(*d*)-10(*f*) show the sequential steps through which the toner supply container 12 is mounted into the apparatus main assembly 100 in which the cartridge 10 is already present Referring to FIGS. 10(*d*)-10(*f*), as the developer supply container 12 is inserted into the apparatus main assembly in which the cartridge 10 is already present, the engagement portion (guiding pin) 10*e*4 attached to the front side (trailing end side) of the cartridge 10 is caught by the cartridge catching portion (slit) 12*f*3*c* of the closing member 12*f*3 (FIG. 10(*d*)). In this state, the rotational phase of the second hole 12*f*3*b* of the closing member 12*f*3 relative to the first opening 12*f*5 (fourth hole 12*f*2*b*) is 90°. Therefore, the first opening 12*f*5 is blocked by the closing member 12*f*3. Designated by a referential number 12*f*2*c* is a slit, which is a part of the closing member 12*f*3. The engaging portion 10*e*4 of the cartridge 10 fits into this slit 12*f*2*c*. Designated by a referential number 12*f*2 is a pressing member.

As the developer supply container 12 is inserted deeper, the closing member 12*f*3 begins to be rotated in the direction indicated by an arrow mark β, about the rotational axle 12*f*3*a* (FIG. 10(*e*)). Then, as the container 12 is further inserted to its final position, the closing member 12*f*3 is rotated to the position shown in FIG. 10(*f*), causing the first opening 12*f*5 (fourth hole 12*f*2*b*) to align with the second hole 12*f*3*b* of the closing member 12*f*3, and therefore, allowing the toner to be supplied from the container 12.

In comparison, referring to FIGS. 10(*a*)-10(*c*), as the cartridge 10 is inserted into the apparatus main assembly 100 in which the developer supply container 12 is already present, the engaging portion 10*e*4 attached to the rear end (leading end) of the cartridge 10 engages into the cartridge catching portion 12*f*3*c* of the closing member 12*f*3 (FIG. 10(*a*)). In this state, the rotational phase of the second hole 12*f*3*b* of the closing member 12*f*3 relative to the first opening 12*f*5 (fourth hole 12*f*2*b*) is 90°. Therefore, the first opening 12*f*5 is blocked by the closing member 12*f*3.

As the cartridge 10 is inserted deeper, the closing member 12*f*3 begins to be rotated in the direction indicated by an arrow mark α, about the rotational axle 12*f*3*a* (FIG. 10(*b*)). Then, as the cartridge 10 is further inserted to its final position, the closing member 12*f*3 is rotated to the position shown in FIG. 10(*c*), causing the first opening 12*f*5 (fourth hole 12*f*2*b*) of the toner supply container 12 to align with the second hole 12*f*3*b* of the closing member 12*f*3, and therefore, allowing the toner to be supplied from the container 12.

Incidentally, when the developer supply container 12 and cartridge 10 are in the state shown in FIGS. 10(*c*) and 10(*f*), the first opening 12*f*5 of the developer supply container 12 and the opening 10*b*1 of the developer inlet 10*b* of the cartridge 10 are aligned with each other, which is needless to say.

Designated by a referential number 12*f*2 is a pressing member, which is structured and attached so that it is allowed to make a slight vertical movement, or slightly tilt, relative to the bottom wall of the developer supply container 12. Therefore, while the developer supply container 12 is inserted, the pressing member 12*f*2 moves in a manner to conform to the shape of the sealing member of the process cartridge 10, preventing the toner from scattering from the container 12.

The descriptions of the preferred embodiment of the present invention given above may be summarized as follows:

The developer supply container 12, which is removably mountable in the electrophotographic image forming apparatus main assembly 100 in order to supply the process cartridge 10 having the electrophotographic photoconductive drum 7 and the charging member 8*a* for charging the electrophotographic photoconductive drum 7, with the developer t while the process cartridge 10 is in the apparatus main assembly 100, comprises:

the developer storage portion 12*k* for storing the developer t;

the developer releasing opening 12*f*1 through which the developer t in the developer storage portion 12*k* is supplied into the process cartridge 10;

the container closing member 12f3 capable of taking the blocking position in which it blocks the developer releasing opening 12f1, and the position into which it retreats from the blocking position to expose the developer releasing opening 12f1;

the first guide 12g1 which is located on one of the walls of the developer supply container 12 intersectional with the lengthwise direction of the developer supply container 12, extending in the lengthwise direction of the developer supply container 12, and which is guided by the one of the guides 20 of the apparatus main assembly 100 when the developer supply container 12 is mounted into the apparatus main assembly 100;

the second guide 12g2 which is located on the other wall of the developer supply container 12 intersectional with the lengthwise direction of the developer supply container 12, extending in the lengthwise direction of the developer supply container 12, and which is guided by the other guide 20 of the apparatus main assembly 100 when the developer supply container 12 is mounted into the apparatus main assembly 100;

the cartridge catching portion 12f3c, by which the engaging portion 10e4 of the process cartridge 10 is caught as the developer supply container 12 is mounted into the apparatus main assembly 100, and which bears the force for moving the closing member 12f3 from the closed position to the open position to expose the developer releasing opening 12f1; and the first container positioning portion 12r2, which is located at the leading end of the developer supply container 12 in terms of the direction in which the developer supply container 12 is mounted into the apparatus main assembly 100 (direction indicated by arrow mark X in FIGS. 5 and 7), and accurately positions the developer supply container 12 relative to the apparatus main assembly 100 by engaging with the container positioning portion 22b of the apparatus main assembly 100;

wherein when the developer supply container 12 is mounted into the apparatus main assembly 100, the developer supply container 12 is accurately positioned relative to the apparatus main assembly 100, as the first container positioning portion 12r2 is positioned by the first container positioning portion 22b of the apparatus main assembly 100, and the trailing end portions of the first and second container guides 12g1 and 12g2, in terms of the cartridge mounting direction, are supported by the pair of container guides 20 of the apparatus main assembly 100, respectively.

The first container positioning portion 12r2 of the developer supply container 12 has a cylindrical hole, whereas the first container positioning portion 22b of the apparatus main assembly 100 is in the form of a cylindrical projection, the external diameter of which is approximately the same as the internal diameter of the cylindrical hole of the first container positioning portion 12r2 of the developer supply container 12, so that the the first container positioning portion 22b of the apparatus main assembly 100 fits into the first container positioning portion 12r2 of the developer supply container 12.

Further, the wall of the developer supply container 12, which faces upward when the developer supply container 12 is in the apparatus main assembly 100, has the elastic member catching portion 31, which comes into contact with the elastic member 29 of the apparatus main assembly 100 and bears the force from the elastic member 29. Therefore, when the developer supply container 12 is in the apparatus main assembly 100, it is kept pressured downward, whereby it is assured that the developer outlet 12f remains perfectly connected with the toner inlet 10i.

Further, the leading end of the developer supply container 12, in terms of the direction in which the container is mounted, is provided with the second container positioning portion 12r1, which is above the first container positioning portion 12r2. The second container positioning portion 12r1 engages with the second container positioning portion 22a of the apparatus main assembly 100, with the presence of no gap in terms of the horizontal direction, but with the presence of a gap between the top of the second container positioning portion 22a of the apparatus main assembly 100, and the opposing portion of the second container positioning portion 12r1 of the developer supply container 12, accurately positioning the developer supply container 12 relative to the apparatus main assembly 100 in terms of the horizontal direction, and therefore, preventing the developer supply container 12 from rotating in the direction intersectional to the lengthwise direction, when the developer supply container 12 receives the driving force transmitted from the apparatus main assembly 100.

The cartridge catching portion 12f3c is a portion of the closing member 12f3 having a slot into which the engaging portion 10e4 of the cartridge 10 caught when the developer supply container 12 is mounted into the apparatus main assembly 100. As the developer supply container 12 is inserted into the apparatus main assembly 100 (in the direction of arrow mark X), the cartridge catching portion 12f3c is pushed by the closing member engaging portion 10e4 of the cartridge 10, causing thereby the closing member 12f3 to move to the open position. In other words, as the container 12 is mounted into the apparatus main assembly 100, the developer releasing opening 12f1 is automatically exposed.

The developer supply container 12 is also provided with the cover 30, which is movable between the position in which it covers the developer releasing opening 12f1 of the bottom wall of the developer storage portion 12k, and the position into which it retracts. As the developer supply container 12 is inserted into the apparatus main assembly 100, the cover 30 engages with the cover engaging portion 68 of the apparatus main assembly 100, being thereby moved from the developer container closing position to its retreat. With the provision of this structural arrangement, as the developer supply container 12 is inserted into the apparatus main assembly 100, the cover 30 which prevents the developer from scattering from the developer releasing opening 12f1 is automatically retracted.

Further, the developer storage portion 12k has the top and bottom chambers 12k2 and 12k3 separated by the partitioning member 12k1 (FIG. 5), which is provided with a hole 12k4 for allowing the developer t in the top chamber 12k2 to fall into the bottom chamber 12k3. The top and bottom chambers 12k2 and 12k3 are provided with developer sending top and bottom members 12b and 12a, respectively. The developer sending top member 12b is rotated to send the developer t to the partitioning member hole 12kr (arrow mark Y in FIG. 5 indicates developer movement). The developer sending bottom member 12a is rotated to send the developer t to the developer releasing opening 12f1. The leading end of the developer supply container 12, in terms of the direction in which the developer supply container 12 is mounted into the apparatus main assembly 100, is provided with a driving force receiving top portion 12e1 through which the developer sending top member 12b receives the rotational driving force from the driving force transmitting member of the apparatus main assembly 100, and a driving force receiving bottom portion 12*e*2 through which the developer sending bottom member 12*a* receives the rotational driving force from the driving force transmitting member of the apparatus main assembly 100. When the process cartridge 10 is in the apparatus main assembly 100, the second container positioning portion 12*r*1, driving force receiving portion 12*e*1, first container positioning portion 12*r*2, and driving force receiving bottom portion 12*e*2, of the developer supply container 12 are located in the listed order, from the top. This positional arrangement improves the degree of accuracy with which the driving force receiving portions 12*e*1 and 12*e*2 are positioned relative to the apparatus main assembly 100.

The cartridge guides 12*g*1 and 12*g*2 extend in the lengthwise direction of the developer supply container 12 across virtually the entire range of the developer supply container 12.

The developer supply container 12 has a handle 12*x*, which is a part of the top portion of the upstream end portion of the developer supply container 12 in terms of the development supply container insertion direction. The handle 12*x* is the portion to be grasped by an operator when the operator pulls out the developer supply container 12 from the apparatus main assembly 100.

In the case in which the process cartridge 10 is mounted into the apparatus main assembly 100 in which the developer supply container 12 is already present, as the process cartridge 10 is inserted into the apparatus main assembly 100, the cartridge catching portion 12*f*3*c* is pushed by the process cartridge 10, causing thereby the closing member 12*f*3 to move from the closed position to the opening position. In other words, as the process cartridge 10 is inserted into the apparatus main assembly 100, the developer releasing opening 12*f*1 is automatically exposed.

Further, the position of the developer supply container 12 relative to the apparatus main assembly 100 is fixed, because the position of the first container positioning portion 12*r*2 is fixed by the first container positioning portion 22*b* of the apparatus main assembly 100, and the positions of the trailing ends of the first and second container guides 12*g*1 and 12*g*2, in terms of the development supply container insertion direction, relative to the apparatus main assembly 100, are fixed by being supported by the container guides 20 of the apparatus main assembly 100. Therefore, the end portion of the developer supply container 12 having the first container positioning portion 12*r*2 is positioned at a slightly higher level than the trailing end of the developer supply container 12. More specifically, in this embodiment, the developer supply container 12 is set in the apparatus main assembly 100 so that its leading end is positioned 300 μm-1.0 mm higher than the trailing end. With the provision of this arrangement, the container 12 remains in contact with the apparatus main assembly 100 at three areas (A, B, and C areas in FIGS. 9 and 11), remaining thereby accurately positioned.

Further, in this embodiment, when the container 12 is mounted into the apparatus main assembly 100, the first container positioning portion 12*r*2 with the cylindrical wall engages with the first container positioning portion 22*b* of the apparatus main assembly 100 in the form of a pin, while being moved upward by the tapered end portion of the pin 22*b*. Therefore, the position of the container 12 relative to the apparatus main assembly 100 is fixed, with its leading end positioned 300 μm-1.0 mm higher than the trailing end. With the provision of this structural arrangement, the container positioning portion 12*r*2 of the leading end of the developer supply container 12 engages with the container positioning portion 22*b* of the apparatus main assembly 100 (area A in FIGS. 9 and 11), and the trailing end of the developer supply container 12 is supported by the guides 20 of the apparatus main assembly 100, by the trailing end portions of the container guides 12*g*1 and 12*g*2 (areas B and C in FIGS. 9 and 11). In other words, the position of the container 12 relative to the apparatus main assembly 100 is fixed by the three areas A, B, and C, which are comparable to the apexes of a roughly isosceles triangle. Therefore, it is assured that the container 12 is reliably supported by the apparatus main assembly 100 while being accurately positioned relative to the apparatus main assembly 100.

The container positioning portions 12*r*1 and 12*r*2 on the end wall of the developer supply container 12, on the leading side, are approximately in the middle of the container 12 in terms of the width direction of the container 12. Further, the container guide 12*g*1 is on one of the two walls of the container 12 (developer storage portion 12*k*) perpendicular to the width direction of the container 12, extending in the lengthwise direction, and the container guide 12*g*2 is on the other, also extending in the lengthwise direction.

Further, the trailing end portion of the developer supply container 12 is provided with the pressure bearing portion 12*v*, which is kept pressed by the resiliency of the spring 27*a* attached to the door 27 of the image forming apparatus main assembly 100, when the position of the first container positioning portion 12*r*2 is fixed by the first container positioning portion 22*b* of the apparatus main assembly 100, and the trailing ends of the first and second container guides 12*g*1 and 12*g*2, in terms of the development supply container insertion direction are supported by the guides 20 of the apparatus main assembly 100, one for one, whereby the position of the developer supply container 12 relative to the apparatus main assembly 100 is fixed. With the provision of this structural arrangement, the container 12 remains pressured in the direction in which the developer supply container 12 is inserted into the apparatus main assembly 100, assuring that the driving force receiving portions 12*e*1 and 12*e*2 remain properly engaged with the driving force transmitting members 24*a* and 24*b*.

According to the above described embodiment of the present invention, the developer releasing opening, cartridge catching portion, elastic force bearing portion, driving force receiving top portion, and driving force receiving bottom portion, of the developer supply container 12 are located on the leading end side, in terms of the container insertion direction, with respect to the center of the developer supply container 12 in terms of the lengthwise direction of the developer supply container 12, and the first container positioning portion located at the leading end of the container 12 engages with the container positioning portion of the apparatus main assembly 100. Therefore, the leading end side of the container 12 is more accurately positioned relative to the apparatus main assembly 100. In addition, since the above listed functional and structural portions are parts of the leading end side of the container 12, the container 12 can be positioned relative to the apparatus main assembly 100 with a degree of accuracy sufficient in practical terms, with the provision of a simple structural arrangement.

The development supply container in this embodiment includes a container for supplying developer, as well as toner, used in electrophotography. For example, it includes a container for supplying single-component developer, a container for supplying two-component developer, and a container for supplying toner alone when developer is a mixture of toner particles and carrier particles.

The electrophotographic image forming apparatus for forming an image on the recording medium 2 comprises:

(i) the cartridge spaces S1 into which the process cartridge 10 having the charging member 8*a* for charging the photoconductive drum 7 is removably mounted;

(ii) the pair of container guides 20; and (iii) the developer supply container chambers S2 into which the development supply containers 12 comprising: the developer storage portion 12*k* for storing developer; the developer releasing opening 12*f*1 through which the developer t in the developer storage portion 12*k* is supplied into the process cartridge 10; the container closing member 12*f*3 capable of taking the blocking position in which it blocks the developer releasing opening 12*f*1, and the position into which it retreats from the blocking position to expose the developer releasing opening 12*f*1; the first guide 12*g*1 which is located on one of the walls of the developer supply container 12 intersectional with the lengthwise direction of the developer supply container 12, extending in the lengthwise direction of the developer supply container 12, and which is guided by one of the pair of guides 20 of the apparatus main assembly 100, when the developer supply container 12 is mounted into the apparatus main assembly 100; the second guide 12*g*2 which is located on the other wall of the developer supply container 12 intersectional with the lengthwise direction of the developer supply container 12, extending in the lengthwise direction of the developer supply container 12, and which is guided by the other guide 20 of the apparatus main assembly 100, when the developer supply container 12 is mounted into the apparatus main assembly 100; the cartridge catching portion 12*f*3*c*, into which the engaging portion 10*e*4 of the process cartridge 10 engages as the developer supply container 12 is mounted into the apparatus main assembly 100, and which catches and bears the force for moving the closing member 12*f*3 from the closed position to the open position to expose the developer releasing opening 12*f*1; and the first container positioning portion 12*r*2, which is located at the leading end of the developer supply container 12 in terms of the direction in which the developer supply container 12 is mounted into the apparatus main assembly 100 (direction indicated by arrow mark X in FIGS. 5 and 7), and accurately positions the developer supply container 12 relative to the apparatus main assembly 100 by engaging with the container positioning portion 22*b* of the apparatus main assembly 100, wherein when the developer supply container 12 is mounted into the apparatus main assembly 100, the developer supply container 12 is accurately positioned relative to the apparatus main assembly 100, as the position of the first container positioning portion 12*r*2 is fixed by the first container positioning portion 22*b* of the apparatus main assembly 100, and the trailing end portions of the first and second container guides 12*g*1 and 12*g*2 of the developer supply container 12 are supported by the pair of guides 20 of the apparatus main assembly 100, one for one, respectively, are removably mounted; and (iv) the conveying members (3*b*, 3*c*, 3*d*, and 3*g*) for conveying the recording medium 2.

According to the above described embodiment, the container positioning portion of the leading end of the development supply container is accurately positioned relative to the apparatus main assembly, and the trailing ends of the first and second container guides of the development supply container are supported by the pair of container guides of the apparatus main assembly. Therefore, the development supply container is accurately positioned relative to the image forming apparatus main assembly.

As described above, according to the present invention, it is possible to accurately position a developer supply container relative to the main assembly of an image forming apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A developer supply container for supplying a developer to a process cartridge detachably mountable to a main assembly of an electrophotographic image forming apparatus, the process cartridge containing an electrophotographic photosensitive drum and a developing roller configured and positioned to develop an electrostatic latent image formed on the photosensitive drum with the developer, said developer supply container comprising:

a developer accommodating portion configured to accommodate the developer;

a container closing member movable between a closing position in which said container closing member closes said developer supply container and an open position in which said container closing member is retracted from the closing position to open said developer supply opening;

a first container guide capable of being guided by a first main assembly guide provided in the main assembly of the apparatus when said developer supply container is mounted to the main assembly of the apparatus;

a second container guide capable of being guided by a main assembly guide provided in the main assembly of the apparatus when said developer supply container is mounted to the main assembly of the apparatus;

container force receiving portion configured and positioned to receive, when said developer supply container is mounted to the main assembly of the apparatus, a force for opening said developer supply container by movement of said container closing member from the closing position to the open position by engagement with a cartridge engaging portion provided in the process cartridge mounted to the main assembly of the apparatus;

a first container positioning portion, provided at a leading end of said developer supply container with respect to a mounting direction in which said developer supply container is mounted to the main assembly of the apparatus, said first container positioning portion being engageable with a first main assembly positioning portion provided in the main assembly of the apparatus, wherein said developer supply container, when it is mounted to the main assembly of apparatus, said first container positioning portion is positioned by the first main assembly positioning portion;

a developer feeding member which is provided in said developer accommodating portion and which is rotatable to feed the developer to a developer supply opening;

a driving force receiving portion, provided on said leading end, configured and positioned for said developer feeding member to receive a rotational driving force from a driving force transmission member provided in the main assembly of the apparatus;

said developer supply opening being configured and positioned to supply the developer accommodated in said developer accommodating portion to the process cartridge, said developer supply opening being provided in the leading side of said developer supply container and at the bottom surface of said developer supply container when said first container positioning a portion is positioned relative to the first main assembly positioning portion; and an elastic force receiving portion configured and positioned to receive, when said developer supply container is mounted to the main assembly of the apparatus, an elastic force provided by an elastic member which is provided in the main assembly of the apparatus, said elastic force receiving portion being provided on a top surface of said developer supply container when said first container positioning portion is positioned relative to the first main assembly positioning portion by which said developer supply container receives a downward force when said first container positioning portion is positioned relative to the first main assembly positioning portion.

2. A container according to claim 1, further comprising a second container positioning portion at a leading end with respect to the mounting direction above said first container positioning portion, said second container positioning portion being contactable to a second main assembly positioning portion provided in the main assembly of the apparatus in a horizontal direction with a gap at the top, so that said second container positioning portion is capable of positioning said developer supply container relative to the main assembly of apparatus in the horizontal direction.

3. A container according to claim 1, wherein said container force receiving portion is in the form of a recess, and wherein when said developer supply container is mounted to the main assembly of the apparatus, said recess is engaged with the cartridge engaging portion, and said container force receiving portion is pushed, with movement of said developer supply container in the mounting direction, to move said container closing member to the open position.

4. A container according to claim 1, wherein said developer supply container has a cover which is movable between a covering position in which said cover covers said developer supply opening and a retracted position in which said cover is retracted from the covering position, and wherein when said developer supply content is mounted to the main assembly of the apparatus, said cover is engaged with a cover engaging portion provided in the main assembly of the apparatus to move said cover from the covering position to the retracted position.

5. A container according to claim 1, further comprising a grip at an upstream position with respect to the mounting direction to facilitate demounting of said developer supply container from the main assembly of the apparatus.

6. A container according to claim 1, wherein when the process cartridge is mounted to the main assembly of the apparatus with said developer supply container already set in the main assembly of the apparatus, said container force receiving portion is pushed to move said container closing member from the closing position to the opening position with movement of said process cartridge in the mounting direction.

7. A container according to claim 1 or 5, further comprising, at a trailing end of said developer supply container with respect to the mounting direction, a portion to be urged by an elastic force of a spring provided on a door of the main assembly of the image forming apparatus when said first container positioning portion is positioned relative to the first main assembly positioning portion, and trailing sides of said first container guide and said second container guide, with respect to the mounting direction, are positioned relative to the main assembly of the apparatus by being supported by the main assembly guide.

8. A developer supply container for supplying a developer to a process cartridge detachably mountable to a main assembly of an electrophotographic image forming apparatus, the process cartridge containing an electrophotographic photosensitive drum and a developing roller configured and positioned to develop an electrostatic latent image formed on the photosensitive drum with the developer, said developer supply container comprising:

a developer accommodating portion configured to accommodate the developer;

a container closing member movable between a closing position in which said container closing member closes said developer supply container and an open position in which said container closing member is retracted from the closing position to open said developer supply opening;

a first container guide capable of being guided by a first main assembly guide provided in the main assembly of the apparatus when said developer supply container is mounted to the main assembly of the apparatus;

a second container guide capable of being guided by a second main assembly guide provided in the main assembly of the apparatus when said developer supply container is mounted to the main assembly of the apparatus;

a container force receiving portion configured and positioned to receive, when said developer supply container is mounted to the main assembly of the apparatus, a force for opening said developer supply container by movement of said container closing member from the closing position to the open position by engagement with a cartridge engaging portion provided in the process cartridge mounted to the main assembly of the apparatus;

a first container positioning portion, provided at a leading end of said developer supply container with respect to a mounting direction in which said developer supply container is mounted to the main assembly of the apparatus, said first container positioning portion being engageable with a first main assembly positioning portion provided in the main assembly of the apparatus, wherein when said developer supply container is mounted to the main assembly of the apparatus, said first container positioning portion is positioned by the first main assembly positioning portion;

a developer feeding member which is provided in said developer accommodating portion and which is rotatable to feed the developer to a developer supply opening;

a driving force receiving portion, provided on said leading end, configured and positioned for said developer feeding member to receive a rotational driving force from a driving force transmission member provided in the main assembly of the apparatus;

said developer supply opening configured and positioned to supply the developer accommodated in said developer accommodating portion to the process cartridge, said developer supply opening being provided in the leading side of said developer supply container and at the bottom surface of said developer supply container when said first container positioning portion is positioned relative to the first main assembly positioning portion;

an elastic force receiving portion configured and positioned to receive, when said developer supply container is mounted to the main assembly of the apparatus, an elastic force provided by an elastic member which is provided in the main assembly of the apparatus, said elastic force receiving portion being provided on a top surface of said developer supply container when said first container positioning a portion is positioned relative to the first main assembly positioning portion by which said developer supply container receives a downward force when said first container positioning portion is positioned relative to the first main assembly positioning portion; and a grip at an upstream position with respect to the mounting direction to facilitate demounting of said developer supply container from the main assembly of the apparatus, wherein when the process cartridge is mounted to the main assembly of the apparatus with said developer supply container already set in the main assembly of the apparatus, said container force receiving portion is pushed to move said container closing member from the closing position to the opening position with movement of said process cartridge in the mounting direction.

9. A container according to claim 8, wherein said container force receiving portion is in the form of a recess, and wherein when said developer supply container is mounted to the main assembly of the apparatus, said recess is engaged with the cartridge engaging portion, and said container force receiving portion is pushed, with movement of said developer supply container in the mounting direction, to move said container closing member to the open position.

10. A container according to claim 8 or 9, wherein said developer supply container has a cover which is movable between a covering position in which said cover covers said developer supply opening and a retracted position in which said cover is retracted from the covering position, and wherein when said developer supply content is mounted to the main assembly of the apparatus, said cover is engaged with a cover engaging portion provided in the main assembly of the apparatus to move said cover from the covering position to the retracted position.

11. A container according to claim 8 or 9, further comprising a grip at an upstream position with respect to the mounting direction to facilitate demounting of said developer supply container from the main assembly of the apparatus.

12. An electrophotographic image forming apparatus for forming an image on a recording material, said apparatus comprising:

(i) a process cartridge detachably mounted to a main assembly of said electrophotographic image forming apparatus, said process cartridge containing an electrophotographic photosensitive drum and a developing roller configured and positioned to develop an electrostatic latent image formed on the photosensitive drum with the developer;

(ii) a first main assembly guide provided in the main assembly of said apparatus;

(iii) a second main assembly guide provided in the main assembly of said apparatus; and (iv) a developer supply container detachably mounted to the main assembly of said apparatus, said developer supply container including:

a developer accommodating portion configured to accommodate the developer, a container closing member movable between a closing position in which said container closing member closes said developer supply container and an open position in which said container closing member is retracted from the closing position to open a developer supply opening, a first container guide capable of being guided by said first main assembly guide when said developer supply container is mounted to the main assembly of said apparatus;

a second container guide capable of being guided by said second main assembly guide when said developer supply container is mounted to the main assembly of said apparatus;

a container force receiving portion configured and positioned to receive, when said developer supply container is mounted to the main assembly of said apparatus, a force for opening the developer supply opening by movement of said container closing member from the closing position to the open position by engagement with a cartridge engaging portion provided in said process cartridge mounted to the main assembly of said apparatus;

a first container positioning portion, provided at a leading end of said developer supply container with respect to a mounting direction in which said developer supply container is mounted to the main assembly of said apparatus, said first container positioning a portion being engageable with a first main assembly positioning portion provided in the main assembly of said apparatus, wherein when said developer supply container is mounted to the main assembly of the apparatus, said first container positioning a portion is positioned by the first main assembly positioning portion;

a developer feeding member which is provided in said developer accommodating portion and which is rotatable to feed the developer to the developer supply opening;

a driving force receiving portion, provided on said leading end, configured and positioned for said developer feeding member to receiving a rotational driving force from a driving force transmission member provided in the main assembly of said apparatus, said developer supply opening configured and positioned to supply the developer accommodated in said developer accommodating portion to said process cartridge, said developer supply opening being provided in the leading side of said developer supply container and at the bottom surface of said developer supply container when said first container positioning portion is positioned relative to the first main assembly positioning portion; and an elastic force receiving portion configured and positioned to receive, when said developer supply container is mounted to the main assembly of said apparatus, an elastic force provided by an elastic member which is provided in the main assembly of said apparatus, said elastic force receiving portion being provided on a top surface of said developer supply container when said first container positioning portion is positioned relative to the first main assembly positioning portion by which said developer supply container receives a downward force when said first container positioning portion is positioned relative to the first main assembly positioning portion.

13. An electrophotographic image forming apparatus for forming an image on a recording material, said apparatus comprising:

(i) a process cartridge detachably mounted to a main assembly of said electrophotographic image forming apparatus, said process cartridge containing an electrophotographic photosensitive drum and a developing roller configured and positioned to develop an electrostatic latent image formed on said photosensitive drum with the developer;

(ii) a first main assembly guide provided in the main assembly of said apparatus;

(iii) a second main assembly guide provided in the main assembly of said apparatus; and (iv) a developer supply container detachably mounted to the main assembly of said apparatus, said developer supply container comprising:

a developer accommodating portion configured to accommodate the developer;

a container closing member movable between a closing position in which said container closing member closes said developer supply container and an open position in which said container closing member is retracted from the closing position to open said developer supply opening;

a first container guide capable of being guided by said first main assembly guide provided in the main assembly of said apparatus when said developer supply container is mounted to the main assembly of said apparatus;

a second container guide capable of being guided by said second main assembly guide provided in the main assembly of said apparatus when said developer supply container is mounted to the main assembly of said apparatus;

a container force receiving portion configured and positioned to receive, when said developer supply container is mounted to the main assembly of said apparatus, a force for opening said developer supply container by movement of said container closing member from the closing position to the open position by engagement with a cartridge engaging portion provided in said process cartridge mounted to the main assembly of said apparatus;

a first container positioning portion, provided at a leading end of said developer supply container with respect to a mounting direction in which said developer supply container is mounted to the main assembly of said apparatus, said first container positioning portion being engageable with a first main assembly positioning portion provided in the main assembly of said apparatus;

wherein when said developer supply container is mounted to the main assembly of said apparatus, said first container positioning portion is positioned by the first main assembly positioning portion;

a developer feeding member which is provided in said developer accommodating portion and which is rotatable to feed the developer to a developer supply opening;

a driving force receiving portion, provided on said leading end, configured and positioned for said developer feeding member to receive a rotational driving force from a driving force transmission member provided in the main assembly of the apparatus;

said developer supply opening configured and positioned to supply the developer accommodated in said developer accommodating portion to the process cartridge, said developer supply opening being provided in the leading side of said developer supply container and at the bottom surface of said developer supply container when said first container positioning a portion is positioned relative to the first main assembly positioning portion;

an elastic force receiving portion configured and positioned to receive, when said developer supply container is mounted to the main assembly of said apparatus, an elastic force provided by an elastic member which is provided in the main assembly of said apparatus, said elastic force receiving portion being provided on a top surface of said developer supply container when said first container positioning a portion is positioned relative to the first main assembly positioning portion by which said developer supply container receives a downward force when said first container positioning portion is positioned relative to the first main assembly positioning portion; and a grip at an upstream position with respect to the mounting direction to facilitate demounting of said developer supply container from the main assembly of said apparatus, wherein when said process cartridge is mounted to the main assembly of said apparatus with said developer supply container already set in the main assembly of said apparatus, said container force receiving portion is pushed to move said container closing member from the closing position to the opening position with movement of said process cartridge in the mounting direction.

* * * * *

UNITED STATES PATENT AND TRADEMARK OFFICE

CERTIFICATE OF CORRECTION

PATENT NO. : 7,366,452 B2
APPLICATION NO. : 11/565755
DATED : April 29, 2008
INVENTOR(S) : Akiyoshi Fujita et al.

It is certified that error appears in the above-identified patent and that said Letters Patent is hereby corrected as shown below:

COLUMN 2
Line 51, “end” should read --end of--.
Line 52, “term” should read --terms--.

COLUMN 3
Line 54, “Left” should read --left--.

COLUMN 4
Line 11, “1N” should read --1M--.

COLUMN 7
Line 35, “magenta cyan,” should read --magenta, cyan,--.
Line 53, “12el),” should read --12el,--.

COLUMN 8
Line 14, “(12Y, 12” should read --(12Y, 12M--.
Line 42, “apparatus, are” should read --apparatus are--.

COLUMN 9
Line 9, “12N,” should read --12M,--.

COLUMN 18
Line 36, “container” should read --a container--.
Line 53, “apparatus,” should read --the apparatus,--.

COLUMN 19
Line 30, “apparatus” should read --the apparatus--.
Line 48, “content” should read --container--.

COLUMN 21
Line 13, “a” should be deleted.
Line 28, “opening” should read --open--.
Line 47, “content” should read --container--.

COLUMN 22
Line 43, “a” should be deleted.

UNITED STATES PATENT AND TRADEMARK OFFICE

CERTIFICATE OF CORRECTION

PATENT NO. : 7,366,452 B2
APPLICATION NO. : 11/565755
DATED : April 29, 2008
INVENTOR(S) : Akiyoshi Fujita et al.

It is certified that error appears in the above-identified patent and that said Letters Patent is hereby corrected as shown below:

COLUMN 24
Line 18, the right margin should be closed up.
Line 27, “a” should be deleted.
Line 37, “a” should be deleted.

Signed and Sealed this

Twentieth Day of January, 2009

JON W. DUDAS
*Director of the United States Patent and Trademark Office*